US010224606B2

(12) United States Patent
Kim et al.

(10) Patent No.: US 10,224,606 B2
(45) Date of Patent: Mar. 5, 2019

(54) ELECTRONIC DEVICE WITH MULTI-BAND ANTENNA FOR SUPPORTING CARRIER AGGREGATION USING NON-SEGMENTED CONDUCTIVE BORDER MEMBER

(71) Applicant: SAMSUNG ELECTRO-MECHANICS CO., LTD., Suwon-si (KR)

(72) Inventors: Nam Ki Kim, Suwon-si (KR); Dae Seong Jeon, Suwon-si (KR); Young Min Cheon, Suwon-si (KR); Hyun Do Park, Suwon-si (KR); Dae Ki Lim, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 265 days.

(21) Appl. No.: 15/158,845

(22) Filed: May 19, 2016

(65) Prior Publication Data

US 2017/0033440 A1 Feb. 2, 2017

(30) Foreign Application Priority Data

Jul. 30, 2015 (KR) ..... 10-2015-0108246
Dec. 30, 2015 (KR) ..... 10-2015-0189250

(51) Int. Cl.
*H01Q 1/24* (2006.01)
*H01Q 1/48* (2006.01)
(Continued)

(52) U.S. Cl.
CPC ..... *H01Q 1/243* (2013.01); *H01Q 1/48* (2013.01); *H01Q 1/521* (2013.01); *H01Q 5/328* (2015.01); *H01Q 5/335* (2015.01); *H01Q 9/42* (2013.01)

(58) Field of Classification Search
CPC ..... H01Q 1/243; H01Q 1/48; H01Q 9/42; H01Q 5/328; H01Q 5/335; H01Q 1/521
See application file for complete search history.

(56) References Cited

U.S. PATENT DOCUMENTS

2012/0009983 A1 1/2012 Mow et al.
2012/0231750 A1 9/2012 Jin et al.
(Continued)

FOREIGN PATENT DOCUMENTS

JP 2013-214953 A 10/2013
KR 10-2012-0004338 A 1/2012
(Continued)

*Primary Examiner* — Dieu Hien T Duong
(74) *Attorney, Agent, or Firm* — NSIP Law

(57) ABSTRACT

An electronic device including a multi-band antenna, a cover, a substrate, and a conductive border member is disclosed, where the device includes a first feed terminal connected to a circuit of a substrate embedded in the device, a second feed terminal connected to the circuit and insulated from the first feed terminal, a ground disposed on the substrate, a conductive border member continuously disposed along a periphery of the electronic device, a first antenna connected to the first feed terminal and the conductive border member, and the first antenna forming a multiple resonance for covering a first multi-band having a plurality of bands, a second antenna connected to the second feed terminal and the conductive border member and the second antenna forming a multiple resonance for covering a second multi-band, and a bypass conductor to bypass interference signals generated by the first antenna and the second antenna to the ground.

27 Claims, 15 Drawing Sheets

(51) Int. Cl.

| | |
|---|---|
| ***H01Q 1/52*** | (2006.01) |
| ***H01Q 9/42*** | (2006.01) |
| ***H01Q 5/328*** | (2015.01) |
| ***H01Q 5/335*** | (2015.01) |

(56) References Cited

U.S. PATENT DOCUMENTS

| | | | | |
|---|---|---|---|---|
| 2013/0207854 | A1* | 8/2013 | Ryu | H01Q 5/35 343/702 |
| 2013/0257674 | A1 | 10/2013 | Li et al. | |
| 2014/0292590 | A1* | 10/2014 | Yoo | H01Q 1/243 343/702 |

FOREIGN PATENT DOCUMENTS

| | | | |
|---|---|---|---|
| KR | 10-2012-0102517 | A | 9/2012 |
| KR | 10-2014-0119928 | A | 10/2014 |

* cited by examiner

D1: DISTANCE BETWEEN CONTACTS P31 AND P33
L(900) : (1/8)λ
M(2000) : (1/4)λ
H(2600) : (1/3)λ

D2: LENGTH OF FIRST BRIDGE ANTENNA PATTERN
L(900) : (1/11)λ
M(2000) : (1/5)λ

D3: DISTANCE BETWEEN CONTACTS P31 AND P32
L(900) : (1/30)λ
M(2000) : (1/13.5)λ

D4: LENGTH OF A51
L(900) : (1/8)λ
M(2000) : (1/4)λ

D5: DISTANCE BETWEEN CONTACTS P33 AND P39
L(900) : (1/3.5)λ ~ (1/4)λ
M(2000) : (1/1.5)λ ~ (1/2)λ

State.4 => SW3(OFF) : B3/B2/B1/B30 f_M2(by A72, 371)

f_H1(by A71)

G31 B3 : −4.33dB (36.1%), B2 : −4.41dB (36.3%), B1 : −6.95dB (20.2%), B30 : −7.41dB (18.2%)
G32 B3 : −5.80dB (26.3%), B2 : −3.74dB (42.3%), B1 : −6.92dB (20.3%) B7 : −6.92dB (23.5%)

ELECTRONIC DEVICE WITH MULTI-BAND ANTENNA FOR SUPPORTING CARRIER AGGREGATION USING NON-SEGMENTED CONDUCTIVE BORDER MEMBER

CROSS-REFERENCE TO RELATED APPLICATION

This application claims the benefit under 35 U.S.C. § 119(a) of Korean Patent Application Nos. 10-2015-0108246 filed on Jul. 30, 2015 and 10-2015-0189250 filed on Dec. 30, 2015 in the Korean Intellectual Property Office, the entire disclosure of which is incorporated herein by reference for all purposes.

BACKGROUND

1. Field

The following description relates to an electronic device including a multi-band antenna that supports carrier aggregation (CA) using a non-segmented conductive border member.

2. Description of Related Art

Portable electronic devices, such as smartphones, being designed to include a metal exterior have become popular. The metal exterior has drawn much attention to improve external rigidity and to protect an interior of the portable electronic device.

For example, a conductive border member is used in the exterior design of the electronic device, and a conductor frame is embedded in the interior of the electronic device.

Research and development is being conducted to use the conductive border member of portable electronic devices using metal exterior as a portion of an antenna.

For example, in existing antenna using the conductive border member of the portable electronic device or in using conductive border member as a portion of the antenna, a gap (or segmentation) may be formed, from which a portion of the conductive border member exposed externally is removed. The gap allows the segmented conductive border member to be used as the antenna.

As such, segmenting the conductive border member may secure a length and performance of the antenna. However, segmenting of the conductive border member may spoil an appearance and have a low yield upon metal processing.

Further, to secure antenna performance, most of the electronic devices may use the segmented conductive border member having a total of four segmentations including two upper segmentations and two lower segmentations.

For example, the four segmentations use separate independent conductive border members at centers of the upper and lower portions thereof as the antenna. Also, in the four segmentations, a separate manufacturing process is needed to for the segmented portions upon manufacturing of a metal frame and, therefore, productivity may be reduced and a defect rate may be increased. As a result, in an electronic device with a non-segmented conductive border member, not the existing segmented structure, a need to secure antenna performance needs to be increased.

Meanwhile, as a part of an evolution trend of a long term evolution-advanced (LTE-advanced) communications system, carrier aggregation (CA) technology that is a core technology of 3rd Generation Partnership Project release-10 (3GPP Rel-10) has standardized technologies of combining more than two carriers to efficiently use a frequency and to improve a maximum transmission rate.

As an example of communications methods of supporting the foregoing LTE-advanced carrier aggregation (CA) may be communication methods, such as, for example, 1UL/2DLs inter-band CA, 1UL/3DLs inter-band CA, or TDD-FDD CA.

A downlink data transmission rate may be up to 150 Mbps (category 4UE) in the case of 2-layer transmission, in which the number of receiver antennas of the electronic device is two, and may be up to 300 Mbps (category 6UE) in the case of 4-layer transmission, in which the number of receiver antennas of the electronic device is four, or when the number of receiver antennas is two and 2DL CA is used. To this end, a technique of designing a receiver antenna has been highlighted as an important problem.

Further, due to the structure of the electronic device using the conductive border member, the number of receiver antennas may be increased and, therefore, an isolation problem between the antennas may occur. As a result, the isolation problem needs to be solved.

Considering the foregoing matters, to support frequencies for each communications company in each country, an electronic device using the conductive border member needs an improved and innovative antenna structure.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect there is provided an electronic device, including a first feed terminal connected to a circuit of a substrate embedded in the electronic device, a second feed terminal connected to the circuit and electrically insulated from the first feed terminal, a ground disposed on the substrate, a conductive border member continuously disposed along a periphery of the electronic device, a first antenna connected to the first feed terminal and the conductive border member, and forming a multiple resonance for covering a first multi-band having a plurality of bands, a second antenna connected to the second feed terminal and the conductive border member and forming a multiple resonance for covering a second multi-band, and a bypass conductor configured to bypass interference signals generated by the first antenna and the second antenna to the ground.

The first antenna may include a first antenna pattern disposed along an edge of a cover of the electronic device, the first antenna pattern having one end connected to the first feed terminal and the conductive border member and the other end open, and having a first electrical length, and a first bridge antenna pattern disposed on the cover and pattern having one end connected to the first antenna pattern and the other end connected to the conductive border member.

The first antenna may include a first outer conductor including a portion of the conductive border member from a first point connected to the first feed terminal and the first antenna pattern to a second point spaced at a second electrical length apart from the first point in a first direction, and a second outer conductor including a portion of the conductive border member from a third point of the conductive border member to a fourth point spaced at a third electrical length apart from the third point in a second direction, and wherein the second point may be connected to the ground, the third point may be connected to the other end of the first bridge antenna pattern, and the fourth point may be connected to the bypass conductor.

The second antenna may include a second antenna pattern disposed on the cover, the second antenna pattern having one end connected to the second feed terminal and the other end open, and the second antenna pattern having a fourth electrical length, and a second bridge antenna pattern disposed on the cover and having one end connected to the second antenna pattern and the other end connected to the conductive border member.

The second antenna may include a third outer conductor including a portion of the conductive border member from a fifth point of the conductive border member connected to the other end of the second bridge antenna pattern to a sixth point spaced at a fifth electrical length apart in one direction, and a fourth outer conductor including a portion of the conductive border member from the fifth point of the conductive border member to a seventh point spaced as much as a sixth electrical length apart in the other direction, and wherein the sixth point may be connected to the ground of the substrate and the seventh point may be connected to the second feed terminal through a switch.

The second antenna may include a matching circuit disposed between the one end of the second antenna pattern and the fourth point to form impedance matching for a high band in the second multi-band.

The first antenna may include a first capacitor circuit inserted into a transmission line connecting the first feed terminal to the first point, and the bypass path may include a second capacitor circuit disposed between one point of the conductive border member between the second outer conductor and the fourth outer conductor and the ground to have a capacitance for bypassing the signal generated by the first antenna to the ground.

The matching circuit may include fourth and fifth capacitance parts connected to each other in series, and the fourth and the fifth capacitance parts may comprise a capacitance element having a level of capacitance less than that of the second capacitor circuit.

The first multi-band and the second multi-band may overlap each other.

The first multi-band and the second multi-band may not overlap each other.

In one general aspect there is provided an electronic device, including a first feed terminal connected to a circuit of a substrate embedded in the electronic device, a second feed terminal connected to the circuit and electrically insulated from the first feed terminal, a ground disposed on the substrate, a conductive border member continuously disposed along a periphery of the electronic device, a first antenna including a first antenna pattern connected to the first feed terminal and the conductive border member and the first antenna forming a multiple resonance for covering a first multi-band having a plurality of bands using the first antenna pattern and the conductive border member, a second antenna connected to the second feed terminal and the conductive border member, and forming a multiple resonance for covering a second multi-band that does not overlap the first multi-band using the second antenna pattern and the conductive border member, and a bypass conductor configured to alternately connect the conductive border member between the first antenna and the second antenna to the ground.

The first antenna pattern may include a first antenna pattern disposed along an edge of a cover of the electronic device, the first antenna pattern having one end connected to the first feed terminal and the conductive border member, and the other end open, and the first antenna pattern having a first electrical length, and a first bridge antenna pattern disposed on the cover and having one end connected to the first antenna pattern and the other end connected to the conductive border member.

The first antenna may include a first outer conductor including a portion of the conductive border member from a first point connected to the first feed terminal and the first antenna pattern to a second point spaced at a second electrical length apart in a first direction, and a second outer conductor including a portion of the conductive border member from a third point of the conductive border member to a fourth point spaced at a third electrical length apart from the third point in a second direction, and wherein the second point may be connected to the ground of the substrate, the third point may be connected to the other end of the first bridge antenna pattern, and the fourth point may be connected to the bypass conductor.

The second antenna pattern may include a second antenna pattern disposed on the cover, having one end connected to the second feed terminal and the other end open, and the second antenna pattern may have a fourth electrical length, and a second bridge antenna pattern disposed on the cover and having one end connected the second antenna pattern and the other end connected to the conductive border member.

The second antenna may include a third outer conductor including a portion of the conductive border member from a fifth point of the conductive border member connected to the other end of the second bridge antenna pattern to a sixth point spaced at a fifth electrical length apart in one direction, and a fourth outer conductor including a portion of the conductive border member from the fifth point of the conductive border member to a seventh point spaced as much as a sixth electrical length apart in the other direction, and wherein the sixth point may be connected to the ground of the substrate and the seventh point may be connected to the second feed terminal through a switch.

The second antenna may include a matching circuit disposed between the one end of the second antenna pattern and the fourth point to form impedance matching for a high band in the second multi-band.

The first antenna apparatus may include a first capacitor circuit inserted into a transmission line connecting the first feed terminal to the first point, and the bypass conductor may include a second capacitor circuit disposed between one point of the conductive border member between the second outer conductor and the fourth outer conductor and the ground to have a capacitance for bypassing the signal generated by the first antenna apparatus to the ground.

The first antenna apparatus may include a switch controlling a current path and a frequency band.

The bypass conductor may be configured to bypass signals generated by the first antenna and the second antenna to the ground.

In one general aspect there is provided an electronic device, including a first feed terminal connected to a circuit of a substrate of the electronic device, a second feed terminal connected to the circuit and electrically insulated from the first feed terminal, a conductive border member disposed along a periphery of the electronic device, a first antenna including a first switch configured to control the current path and the frequency band, and the first antenna being connected to the first feed terminal and the conductive border member, a second antenna including a second switch configured to control the current path and the frequency band, and the second antenna being connected to the second feed terminal and the conductive border member, and a bypass conductor configured to bypass interference signals generated by the first antenna and the second antenna to a ground of the substrate.

The first antenna may include a first outer conductor including a portion of the conductive border member extending from a first point connected to the first feed terminal and a first antenna pattern of the first antenna to a second point connected to the ground, and a second outer conductor including a portion of the conductive border member extending from a third point connected to a first bridge antenna pattern of the first antenna to a fourth point connected to the bypass path.

The first switch may be disposed on the substrate between the first point and the second point, and the first switch may include a first terminal connected to the ground and a second terminal connected to the first outer conductor.

The second antenna may include a third outer conductor including a portion of the conductive border member extending from a fifth point connected to an end of a second bridge antenna pattern of the second antenna to a sixth point connected to the ground, and a fourth outer conductor including a portion of the conductive border member extending from the from the fifth point to a seventh point connected to the second feed terminal through a switch.

The second switch may be disposed on the substrate, and the second switch may include a first terminal connected to the second feed terminal and a second terminal connected to the fourth outer conductor.

Other features and aspects will be apparent from the following detailed description, the drawings, and the claims.

Figure 1A:
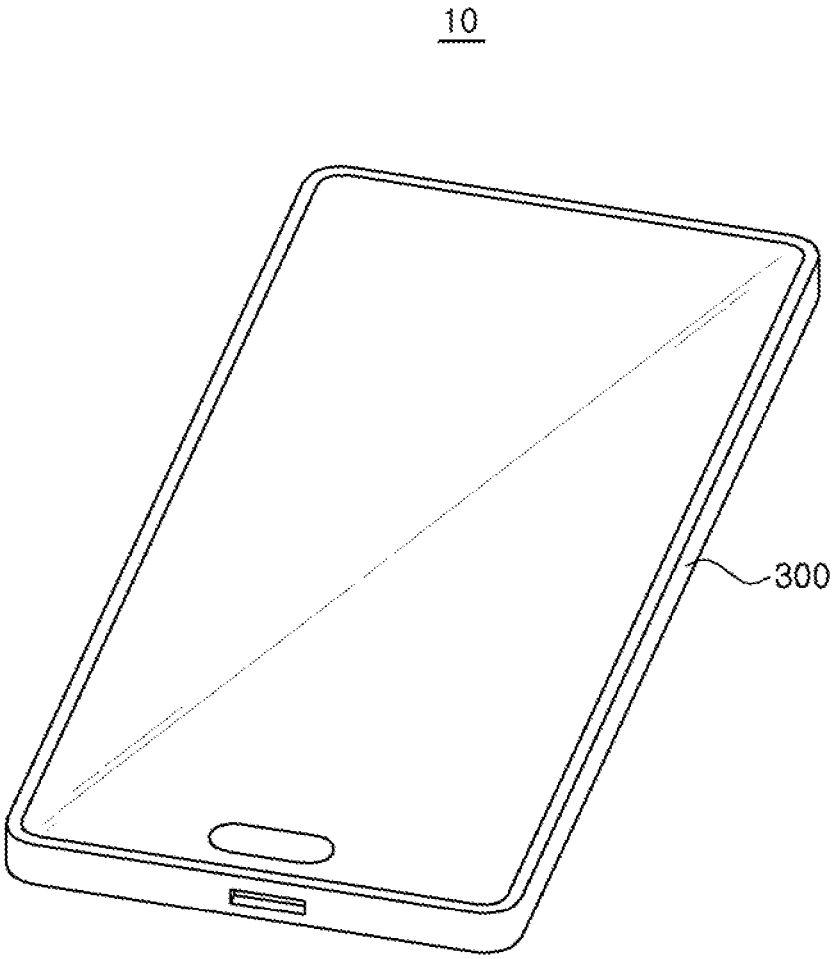
FIG. 1A is diagram illustrating an example of an electronic device including a multi-band antenna.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the systems, apparatuses and/or methods described herein will be apparent to one of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Various alterations and modifications may be made to the examples. Here, the examples are not construed as limited to the disclosure and should be understood to include all changes, equivalents, and replacements within the idea and the technical scope of the disclosure.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" other elements would then be oriented "below," or "lower" the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms "a," "an," and "the" are intended to include the plural forms as well, unless the context clearly indicates otherwise.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape results in manufacturing. The following embodiments may also be constituted by one or a combination thereof.

The contents of the present disclosure described below may have a variety of configurations and propose only a required configuration herein, but are not limited thereto.

In accordance with an embodiment, there is provided an electronic device including a multi-band antenna to support, for example, LTE-advanced carrier aggregation (CA) using a non-segmented conductive border member instead of two lower segmentations among the existing four segmentations, without reducing communications sensitivity. A person skilled in the art will appreciate that the embodiment is not limited to LTE technologies, but may also applied to past, current, or future telecommunications technologies, such as, for example, LTE-Advanced, 3rd Generation Partnership Project (3GPP), and 5G Public-Private Partnership Association (5GPPP).

In general, an antenna of a smartphone is affected by a set structure of the antenna. Performance of a main antenna disposed at a lower end portion of the smartphone may deteriorate due to a variety of conditions such as, for example, a liquid crystal display part of a front part of the smartphone, a ground condition, a vibration of a motor, a speaker, an ear-jack, a USB connector. Further, radiation performance of the main antenna may severely deteriorate under a conductive border member structure of the smartphone or electronic device.

Further, in the conductive border member structure, the existing planar inverted F antenna (PIFA) and loop type antenna may have difficulty overcoming narrowband characteristics. In addition, to improve efficient use of LTE-advanced communications frequencies to support CA technology and to improve a maximum transmission rate, research and development to support different communications frequency bands for each country and to implement frequency aggregation by using frequency aggregation technology of combining at least two carriers may be desired.

Further, it is more difficult to design an antenna to support a multi-band structure under the conductive border member structure. To address deficiencies in existing antennas, there is a need for a structure and corresponding process of a new antenna structure, as described below.

In one embodiment, new antenna structure has a non-segmented conductive border member structure, and may be implemented as a low-middle (LM) band antenna apparatus using a conductive border member of one side (for example, the left side) based on a USB port and a middle-high (MH) band antenna apparatus using a conductive border member of the other side (for example, the right side).

The new antenna structure has a structure in which the conductive border member is connected to the feed terminal by at least one capacitive element.

The new antenna structure may have a structure in which the USB connector is connected to a system ground through an inductor element to prevent performance deterioration due to a parasitic resonance of the USB port (IO port) under the non-segmented conductive border member structure.

The new antenna structure may have a structure of using a switch element for supporting the narrowband characteristics and the carrier aggregation (CA) while using the non-segmented conductive border member.

The structure in the present disclosure as described above will be described with reference to FIGS. 1 through 10.

FIG. 1A is an diagram illustrating an example of an electronic device including a multi-band antenna.

Referring to FIG. 1A, an electronic device 10 including a multi-band antenna, according to an embodiment, includes a non-segmented conductive border member 300.

Figure 1B:
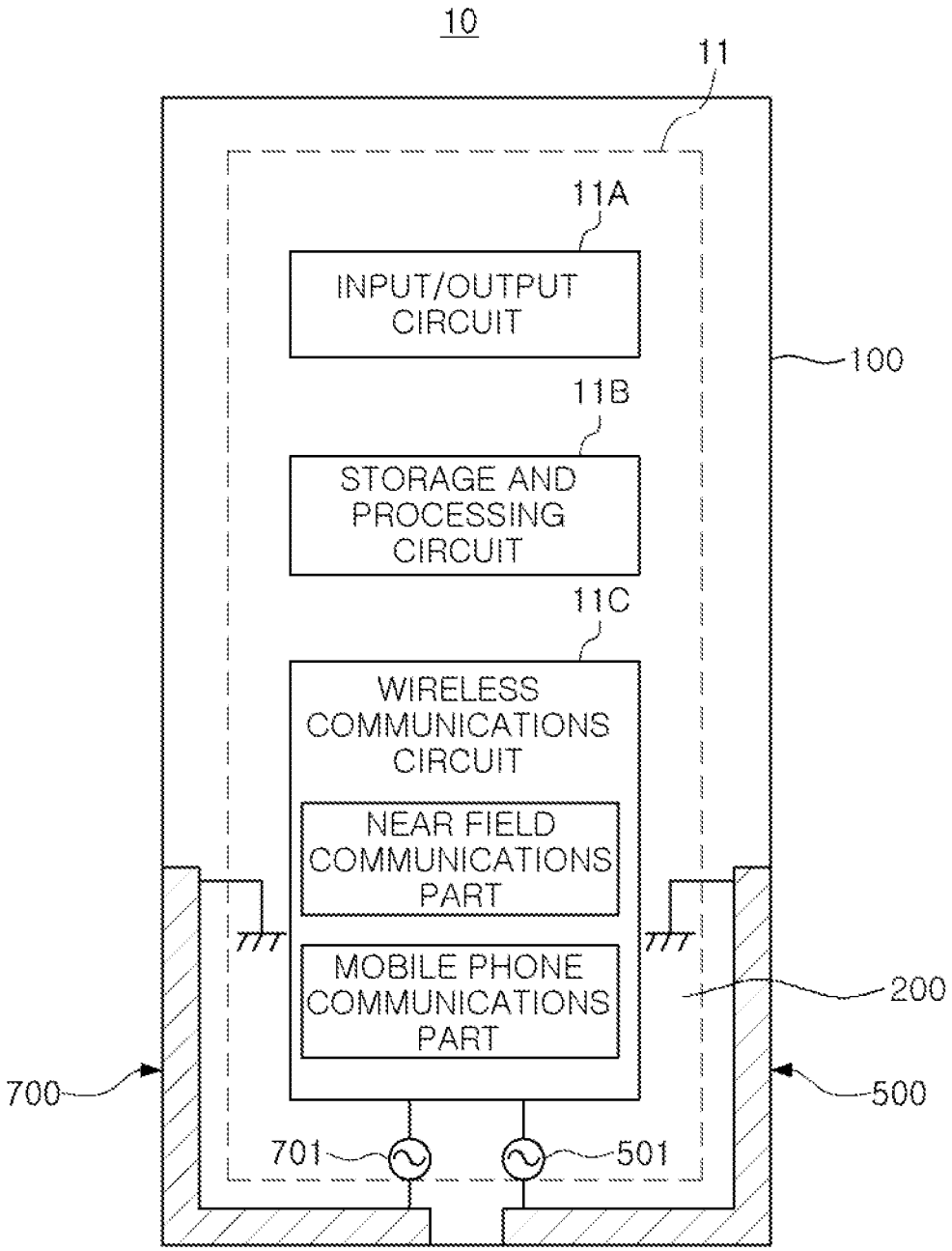
FIG. 1B is a diagram illustrating an example of the electronic device including the multi-band antenna.

FIG. 1B is a diagram illustrating an example of the electronic device including the multi-band antenna.

As a non-exhaustive illustration only, the electronic device 10 shown in FIG. 1B may refer to devices such as, for example, a camera, a cellular phone, a smart phone, a wearable smart device (such as, for example, a ring, a watch, a pair of glasses, glasses-type device, a bracelet, an ankle bracket, a belt, a necklace, an earring, a headband, a helmet, a device embedded in the cloths), a personal computer (PC), a laptop, a notebook, a subnotebook, a netbook, or an ultra-mobile PC (UMPC), a tablet personal computer (tablet), a phablet, a mobile internet device (MID), a personal digital assistant (PDA), an enterprise digital assistant (EDA), a digital camera, a digital video camera, a portable game console, an MP3 player, a portable/personal multimedia player (PMP), a handheld e-book, an ultra mobile personal computer (UMPC), a portable lab-top PC, a global positioning system (GPS) navigation, a personal navigation device or portable navigation device (PND), a handheld game console, an e-book, and devices such as a high definition television (HDTV), an optical disc player, a DVD player, a Blue-ray player, a setup box, robot cleaners, a home appliance, content players, communication systems, image processing systems, graphics processing systems, or any other consumer electronics/information technology (CE/IT) device. The electronic device 10 may be implemented in a smart appliance, an intelligent vehicle, or in a smart home system.

The electronic device 10 may also be implemented as a wearable device, which is worn on a body of a user. In one example, a wearable device may be self-mountable on the body of the user, such as, for example, a watch, a bracelet, or as an eye glass display (EGD), which includes one-eyed glass or two-eyed glasses. In another non-exhaustive example, the wearable device may be mounted on the body of the user through an attaching device, such as, for example, attaching a smart phone or a tablet to the arm of a user using an armband, incorporating the wearable device in a cloth of the user, or hanging the wearable device around the neck of a user using a lanyard.

As shown in FIG. 1B, the electronic device 10 includes a circuit part 11 that is disposed in the cover 100 to provide a signal to a feed terminal. While components related to the present example are illustrated in the electronic device 10 of FIG. 1B, it is understood that those skilled in the art may include other general components, such as, for example, a central processing unit (CPU), an image signal processor (ISP), a memory, a communications modem, and an input/ output interface to support functions required in the electronic device 10. In an operation of the circuit part 11, a ground providing a referential potential may be electrically connected to a ground part GND of a substrate 200.

In an example, the cover 100, the substrate 200, and the conductive border member 300 may be disposed in the order as shown in FIG. 1, but the disposition order of the cover 100, the substrate 200, and the conductive border member 300 is not limited thereto.

In an example, the circuit part 11 includes an input/output circuit 11A for inputting/outputting data, a storage and processing circuit 11B for storing and processing the data, and a wireless communications circuit 11C including a near field communications part and a mobile phone communications part.

The circuit part 11 may perform wireless communications using a multi-band antenna, in which the multi-band antenna may include a first antenna apparatus 500 and a second antenna apparatus 700.

The input/output circuit 11A may be used to input data to the electronic device 10 or output the data to external devices of the electronic device 10.

In an example, the input/output circuit 11A may include a touch screen and an input/output device like other user input interfaces, and may further include a user input/output device such as a button, a joystick, a click wheel, a scrolling wheel, a touch pad, a keypad, a keyboard, a microphone, and a camera. The user input device may receive a command input externally to control the operation of the electronic device 10.

The input/output device may include other components to provide visual information and status data, such as, for example, a display and an audio device. In an example, the display and audio device may include a speaker and audio equipment such as other devices for generating sound.

In an example, the input/output device may include a jack and audio-video interface equipment such as other connectors for an external headphone and a monitor or a display.

In an example, the display may be a physical structure that includes one or more hardware components that provide the ability to render a user interface and/or receive user input. The display can encompass any combination of display region, gesture capture region, a touch sensitive display, and/or a configurable area. The display can be embedded in the hardware or may be an external peripheral device that may be attached and detached from the electronic device 10. The display or input may be a single-screen or a multi-screen display or input. A single physical screen can include multiple displays that are managed as separate logical displays permitting different content to be displayed on separate displays although part of the same physical screen. The display may also be implemented as an eye glass display (EGD), which includes one-eyed glass or two-eyed glasses.

The storage and processing circuit 11B may include a hard disk drive storage and storages such as a nonvolatile memory (for example, flash memory or programmable read-only memory (ROM)) and a volatile memory (for example, static and dynamic random-access-memory (RAM)). The storage or processing circuit 11B may be used to control the operation of the electronic device 10.

The storage and processing circuit 11B may include at least one of a microprocessor, a microcontroller, a digital signal processor, or applications specific integrated circuits (ASIC) by way of example. The storage and processing circuit 11B may be used to allow the electronic device 10 to execute software, such as, for example, Internet browsing applications, voice-over-internet-protocol (VOIP) telephone communications applications, e-mail applications, media player applications, social networking application, gaming applications, navigation applications, and an operating system function. Further, for supporting the interaction with the external equipment, the storage and processing circuit 11B may be used to implement communications protocols. The communications protocols that may be implemented by the storage and processing circuit 11B may include protocols, such as, for example, an Internet protocol, a wireless local area network (WLAN) protocol (for example, IEEE 802.11 protocol or Wi-Fi®), a protocol for other short-range wireless communications links such as a Bluetooth® protocol, a ZigBee protocol, an NFC protocol, radio frequency identification (RFID) protocol, or a mobile phone protocol.

The wireless communications circuit 11C may include components such as, for example, at least one integrated circuit, a power amplifier circuit, a low noise input amplifier, a passive RF component, and a radio frequency (RF) transceiver circuit formed from other circuits for handling an RF signal.

In an example, the wireless communications circuit 11C may include a radio frequency transceiver circuit for handling a plurality of radio frequency communications bands.

Mobile phone standard that may be supported by the electronic device 10 and the wireless communications circuit 11C may include standards such as, for example, a global system for mobile communications (GSM) "2G" mobile phone standard, an evolution-data optimized (EVDO) mobile phone standard, a "3G" universal mobile telecommunications system (UMTS) mobile phone standard, a "3G" code division multiple access 2000 (CDMA 2000) mobile phone standard, a 3GPP long term evolution (LTE) mobile phone standard, LTE-Advanced, or 5G Public-Private Partnership Association (5GPPP). As long as the mobile phone standard is a wireless communications standard, any mobile phone standard may be supported by the electronic device 10 and the wireless communications circuit 11C, without departing from the spirit and scope of the illustrative examples described.

The wireless communications circuit 11C may use the first antenna apparatus 500 and the second antenna apparatus 700 to perform the multi-band communications for supporting the carrier aggregation (CA), in which the first antenna apparatus 500 and the second antenna apparatus 700 may each use the non-segmented conductive border member 300 of the electronic device to support the CA.

Figure 2:
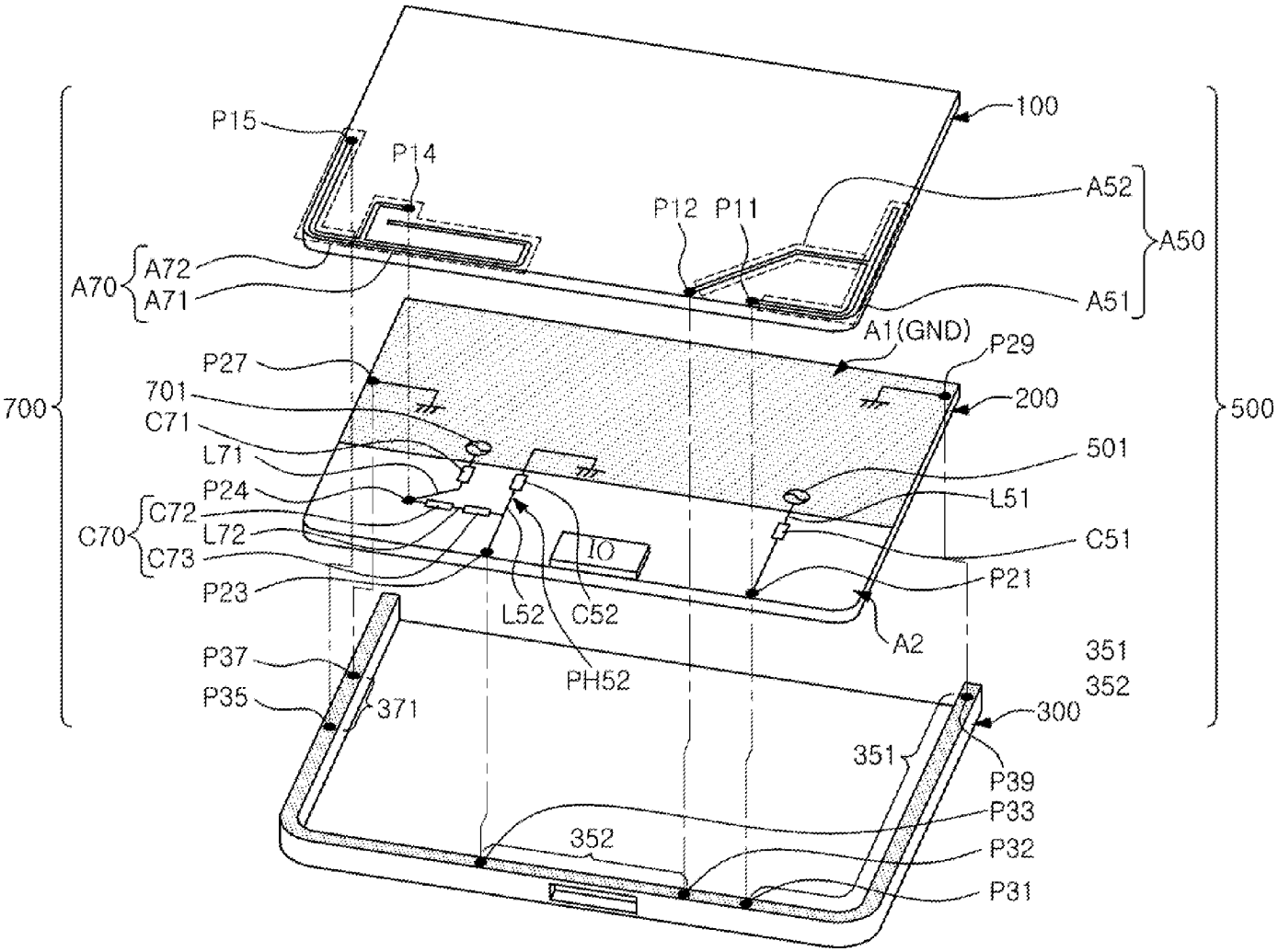
FIG. 2 is a diagram showing a first embodiment of the multi-band antenna.
Figure 3:
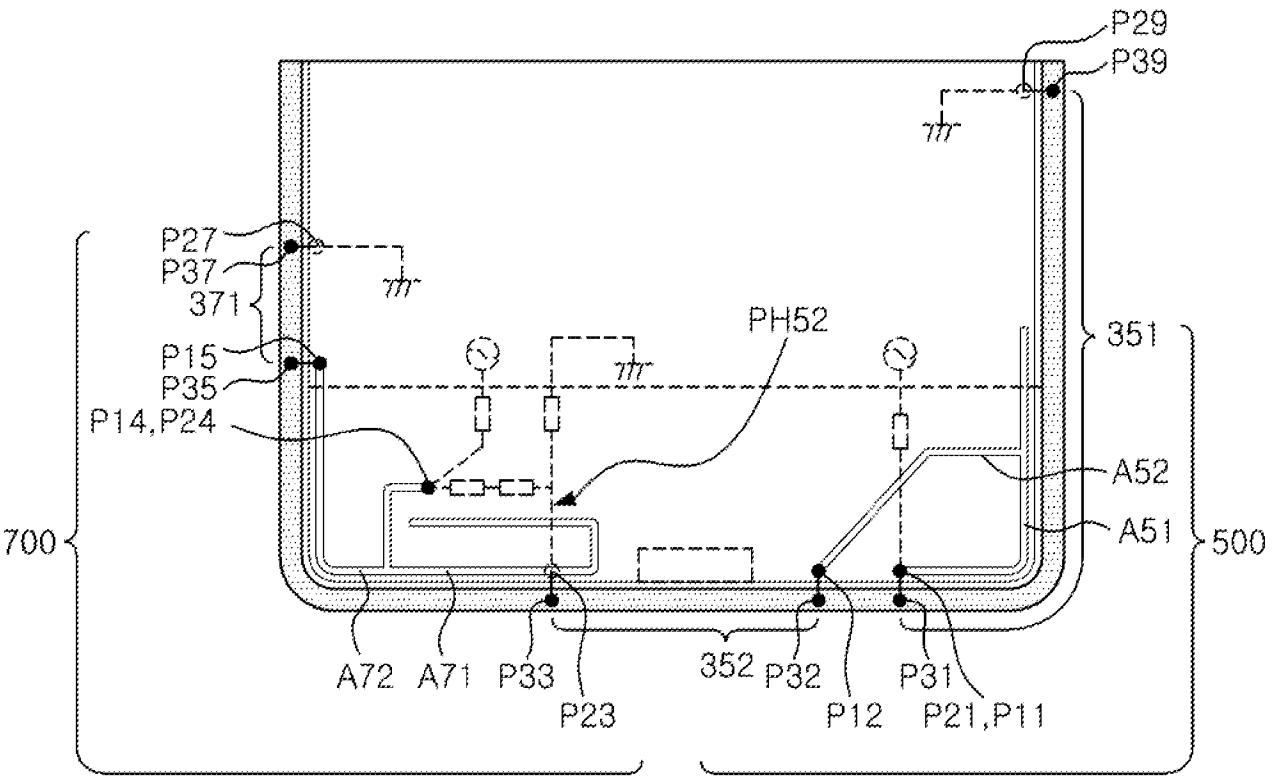
FIG. 3 is a diagram illustrating the first embodiment of the multi-band antenna of FIG. 2.

FIG. 2 is a diagram illustrating a first embodiment of the multi-band antenna. FIG. 3 is another diagram illustrating the first embodiment of the multi-band antenna of FIG. 2.

Referring to FIG. 2, the electronic device 10 may include a peripheral part, a cover 100, a substrate 200, and a conductive border member 300 continuously disposed along the peripheral part.

In this configuration, the substrate 200 may include a circuit part 11 and a ground part GND. The circuit part 11 may be disposed in the cover 100 and may be electrically connected to the ground part GND, a first feed terminal 501, a second feed terminal 701, the first antenna apparatus 500, and the second antenna apparatus 700, respectively.

In an example, the first feed terminal 501 and the second feed terminal 701 may be electrically separated from each other, and as a result may be disposed to be free from interference with each other.

In an example, the substrate 200 includes a metal area (conductive area) A1 and a non-metal area (non-conductive area) A2. The metal area A1 includes at least one circuit part 11 (FIG. 1B) to provide a signal to the first feed terminal 501 and the second feed terminal 701, and the non-metal area A2 may include transmission lines and elements that are included in the first and second antenna apparatuses. In an example, the metal area A1 includes the ground part GND for maintaining a reference potential of the substrate 200.

In an example, the metal area A1 of the substrate 200 may be described as the ground part GND, which does not imply that the whole metal area A1 of the substrate 200 needs to be the ground part GND.

Referring to FIGS. 1 through 3, the conductive border member 300 may be disposed at the peripheral part of the electronic device 10, i.e., at an outside border, and at least a portion of the conductive border member 300 may be formed of a non-segmented conductive material to serve as a radiator of an antenna.

In an example, the conductive border member 300 is integrated with an internal conductive frame disposed in the electronic device 10. In another example, the conductive border member 300 may be separately formed, independent of the internal conductive frame to be assembled in the electronic device. For example, the conductive border member 300 may be integrated with a body of the electronic device 10 or may not be integrated therewith.

In an example, at least the portion serving as the antenna of the conductive border member 300 does not have segmentation. In an example, a portion that does not serve as the antenna may have segmentation. According to the embodiments, the conductive border member 300 need not be segmented to implement the function of the antenna.

Referring to FIGS. 2 and 3, the multi-band antenna includes the first antenna apparatus 500 for supporting a first multi-band and the second antenna apparatus 700 for supporting a second multi-band, for example.

In an example, the first antenna apparatus 500 and the second antenna apparatus 700 may be disposed to face each other, having an input/output (IO)-port of the electronic device disposed therebetween. In an example, the first antenna apparatus 500 and the second antenna apparatus 700 may be disposed at both corners of the electronic device to secure a separation distance from each other within the electronic device to reduce the interference with each other. The disposition structure of the first antenna apparatus 500 and the second antenna apparatus 700 based on the input/output (IO)-port are not limited thereto, but can be disposed in any manner that maintains a separation distance from each other within the electronic device.

The first antenna apparatus 500 and the second antenna apparatus 700 may each be of any suitable antenna type, and may include, for example, a loop antenna structure, a patch antenna structure, an inverted-F antenna structure, and an antenna element or a pattern having a resonance element formed from a hybrid of these designs.

In an example, the first multi-band and the second multi-band may include frequency bands that do not overlap each other. In another example, the first multi-band and the second multi-band may include frequency bands that overlap each other.

For example, the first multi-band may include a low band (700 MHz through 1000 MHz) that is a relatively low frequency band and a middle band (1700 MHz through 2200 MHz) higher than the low band. The second multi-band may include the middle band (1700 MHz through 2200 MHz) and a high band (2300 MHz through 2700 MHz) higher than the middle band.

As long as the first and second multi-bands are bands that may support the CA, the first and second multi-bands need not be limited to the examples.

In an example, the first antenna apparatus 500 includes a first antenna pattern part A50 electrically connected to the first feed terminal 501 and the conductive border member 300. The first antenna apparatus 500 may form a multiple resonance to cover the first multi-band having a plurality of bands using the first antenna pattern part A50 and the conductive border member 300.

The first antenna pattern part A50 may include a first antenna pattern A51 and a first bridge antenna pattern A52.

The first antenna pattern A51 may be disposed along an edge of the cover 100 of the electronic device, and one end of the first antenna pattern A51 may be electrically connected to the first feed terminal 501 and the conductive border member 300. The other end of the first antenna pattern A51 may be open and the first antenna pattern A51 may have a first electrical length.

For example, the first antenna pattern A51 may be disposed along the edge of the cover 100, including the corner of the cover 100 to have the first electrical length (P11—open end) at a contact P11 of the cover 100 electrically connected to a contact P21 of the substrate 200.

The first bridge antenna pattern A52 may be disposed on the cover 100 of the electronic device, and one end of the first bridge antenna pattern A52 may be electrically connected to one point of the first antenna pattern A51, and the other end thereof may be electrically connected to the conductive border member 300.

For example, the first bridge antenna pattern A52 may be disposed along the edge of the cover 100 from one point of the first antenna pattern A51 to a contact P12, including the corner of the cover 100.

The first antenna apparatus 500 may include a first outer conductor part 351 and a second outer conductor part 352.

The first outer conductor part 351 may include conductive border members from a first point P31 connected to the first feed terminal 501 and the first antenna pattern A51 to a second point P39 spaced as much as a second electrical length apart in one direction.

For example, the first outer conductor part 351 may include conductive border members from the contact P31 (first point) of the conductive border member 300 connected to the contact P11 of the cover 100 to a contact P39 (second point) that is a point spaced as much as the second electrical length (P31-P39) apart in one direction.

The second outer conductor part 352 may include conductive border members 300 from a third point P32 of the conductive border member 300 to a fourth point P33 spaced as much as a third electrical length apart in the other direction. In another example, the second outer conductor part 352 may include conductive border members 300 from a first point P31 of the conductive border member 300 to a fourth point P33 in the other direction.

For example, the second outer conductor part 352 may include conductive border members 300 from the contact P32 (third point) of the conductive border member 300 to a contact P33 (fourth point) that is a point spaced as much as the third electrical length (P31-P33) apart in the other direction.

The second point P39 of the first outer conductor part 351 may be electrically connected to the ground part GND of the substrate 200, the third point P32 of the conductive border member 300 may be connected to the other end of the first bridge antenna pattern A52, and the fourth point P33 of the second outer conductor part 352 may be connected to a bypass path PH52 (also referred to as a bypass conductor).

In an example, the contact P39 of the conductive border member 300 is connected to the ground part GND through the contact P29 of the substrate 200. In an example, the contact P33 of the conductive border member 300 is electrically connected to a contact P23 of the substrate 200. In an example, the contacts P23 and P21 of the substrate 200 may be disposed, having the input/output (IO)-port of the electronic device disposed therebetween.

The first antenna pattern A51 and the first bridge antenna pattern A52 may be formed on a layer different from the substrate 200. For example, the first antenna pattern A51 and the first bridge antenna pattern A52 may be disposed on a rear cover 100 of the electronic device 10, or may be disposed in a back cover.

When the first antenna pattern A51 is disposed on the rear cover 100, as shown in FIG. 2, the first antenna pattern A51 may be disposed at an advantageous position in receiving sensitivity. For example, the first antenna pattern A51 may be disposed along the edge of the corner of the rear cover 100.

The contacts, such as the contact P11 and the contact P21, mean connection points for an electrical connection between components disposed on different layers.

For the electrical connection between the two contacts, an electrical connection method between different layers that is applied to a typical electronic device may be applied, such as, for example, a connection through a conductor through hole, a connection through a wire, or a connection through a clip.

In an example, the second antenna apparatus 700 includes a second antenna pattern part A70, which is electrically connected to the second feed terminal 701 and the conductive border member 300. The second antenna apparatus 700 may form a multiple resonance to cover the second multi-band including a band that does not partially overlap the first multi-band using the second antenna pattern part A70 and the conductive border member 300.

In an example, the second antenna apparatus 700 includes a second antenna pattern A71 and a second bridge antenna pattern A72.

The second antenna pattern A71 may be disposed on the cover 100 of the electronic device, and one end of the second antenna pattern A71 may be electrically connected to the second feed terminal 701. The other end of the second antenna pattern A71 may be open and the second antenna pattern A71 may be disposed to have a fourth electrical length.

For example, the second antenna pattern A71 may be disposed to have the fourth electrical length (P14—open end) extended from a contact P14 of the cover 100 electrically connected to a contact P24 of the substrate 200.

The second bridge antenna pattern A72 may be disposed on the cover 100 of the electronic device. One end of the second bridge antenna pattern A72 may be electrically connected to one point of the second antenna pattern A71, and the other end of the second bridge antenna pattern A72 may be electrically connected to the conductive border member 300.

For example, the second bridge antenna pattern A72 may be disposed along the edge of the cover 100 from one point of the second antenna pattern A71 to a contact P15 of the cover 100, including the corner of the cover 100.

The second antenna apparatus 700 may include a third outer conductor part 371.

The third outer conductor part 371 may include conductive border members 300 from a fifth point P35 of the conductive border member 300 electrically connected to the other end of the second bridge antenna pattern A72 to a sixth point P37 spaced as much as a fifth electrical length apart in one direction.

For example, as shown in FIG. 3, the third outer conductor part 371 includes conductive border members 300 from the contact P35 of the conductive border member 300 connected to the contact P15 to a contact P37 that is a point spaced as much as the fifth electrical length (P35-P37) apart in one direction.

In an example, the contact P37 is electrically connected to a contact P27 of the substrate 200 to be connected to the ground part GND.

In an example, the sixth point P37 of the third outer conductor part 371 is electrically connected to the ground part GND of the substrate 200.

The first antenna apparatus 500 may include a first capacitor circuit part C51 that is inserted into a transmission line electrically connecting the first feed terminal 501 and the first point P31 of the first outer conductor part 351.

For example, the first capacitor circuit part C51 may be connected to the first feed terminal 501 disposed on the substrate 200 through a transmission line L51 between the first feed terminal 501 and the contact P21.

The second antenna apparatus 700 may include a third capacitance part C71. The third capacitance part C71 may be connected to the second feed terminal 701 through a transmission line L71 between the second feed terminal 701 and the contact P24.

In an example, the second antenna apparatus 700 includes a matching circuit part C70 (FIG. 2), in which the matching circuit part C70 may be disposed between one end of the second antenna pattern A71 and the fourth point P33. In an example, the bypass path or the bypass conductor PH52 is connected to the fourth point P33 to form impedance matching for the high band in the second multi-band.

The matching circuit part C70 may include fourth and fifth capacitance parts C72 and C73 that are connected to each other in series.

For example, the fourth and fifth capacitance parts C72 and C73 may be connected between the contact P24 of the substrate 200 and a transmission line L52 of the substrate 200 through a transmission line L72 in series. Here, the fourth and fifth capacitance parts C72 and C73 each may include at least one capacitance element, may be set for the impedance matching for a preset frequency band (for example, a high band), and may include a capacitance element having capacitance less than that of a second capacitor circuit part C52.

The bypass path or the bypass conductor PH52 may bypass a mutual interference signal generated by the first antenna apparatus 500 and the second antenna apparatus 700 to the ground part GND of the substrate 200.

As shown in FIG. 2, the bypass path or the bypass conductor PH52 may be disposed between the first antenna apparatus 500 and the second antenna apparatus 700 to alternately connect the conductive border member 300 between the first antenna apparatus 500 and the second antenna apparatus 700 to the ground part GND of the substrate 200, thereby bypassing the signals generated by the first antenna apparatus 500 and the second antenna apparatus 700, respectively, to the ground part GND of the substrate 200.

The bypass path or the bypass conductor PH52 may include the second capacitor circuit part C52. The second capacitor circuit part C52 may be disposed between one point of the conductive border member 300 between the second outer conductor part 352 and a fourth outer conductor part 372 and the ground part GND to have a capacitance for bypassing the signal generated by the first antenna apparatus 500 to the ground.

For example, the second capacitor circuit part C52 is connected between the contact P23 of the substrate 200 and the ground part GND of the substrate 200 through the transmission line L52. Here, the second capacitor circuit part C52 may include at least one capacitance element, and may include a capacitance element having a level of capacitance that is sufficient to alternately ground an alternating current signal.

Figure 4:
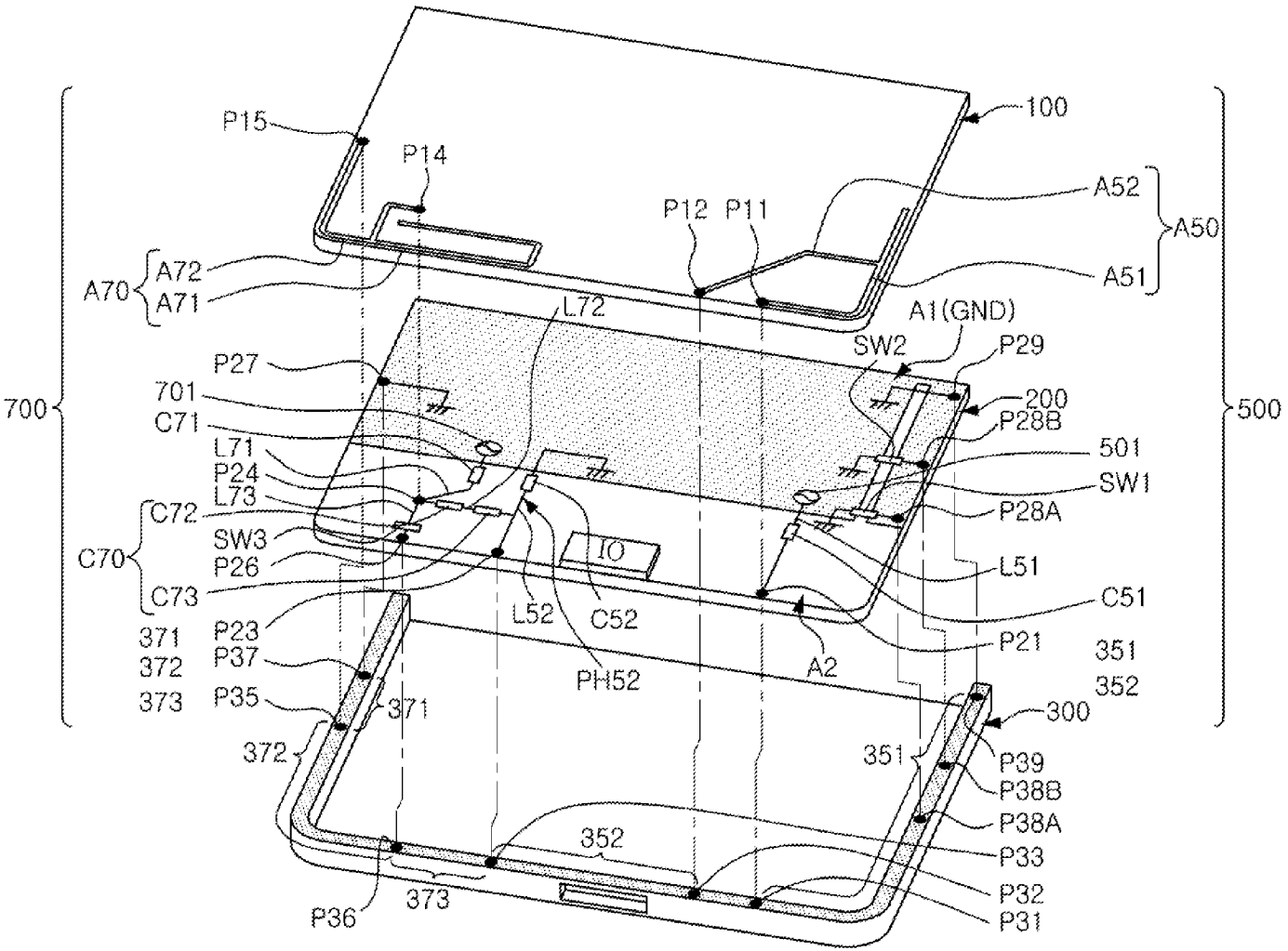
FIG. 4 is a diagram illustrating a second embodiment of the multi-band antenna.
Figure 5:
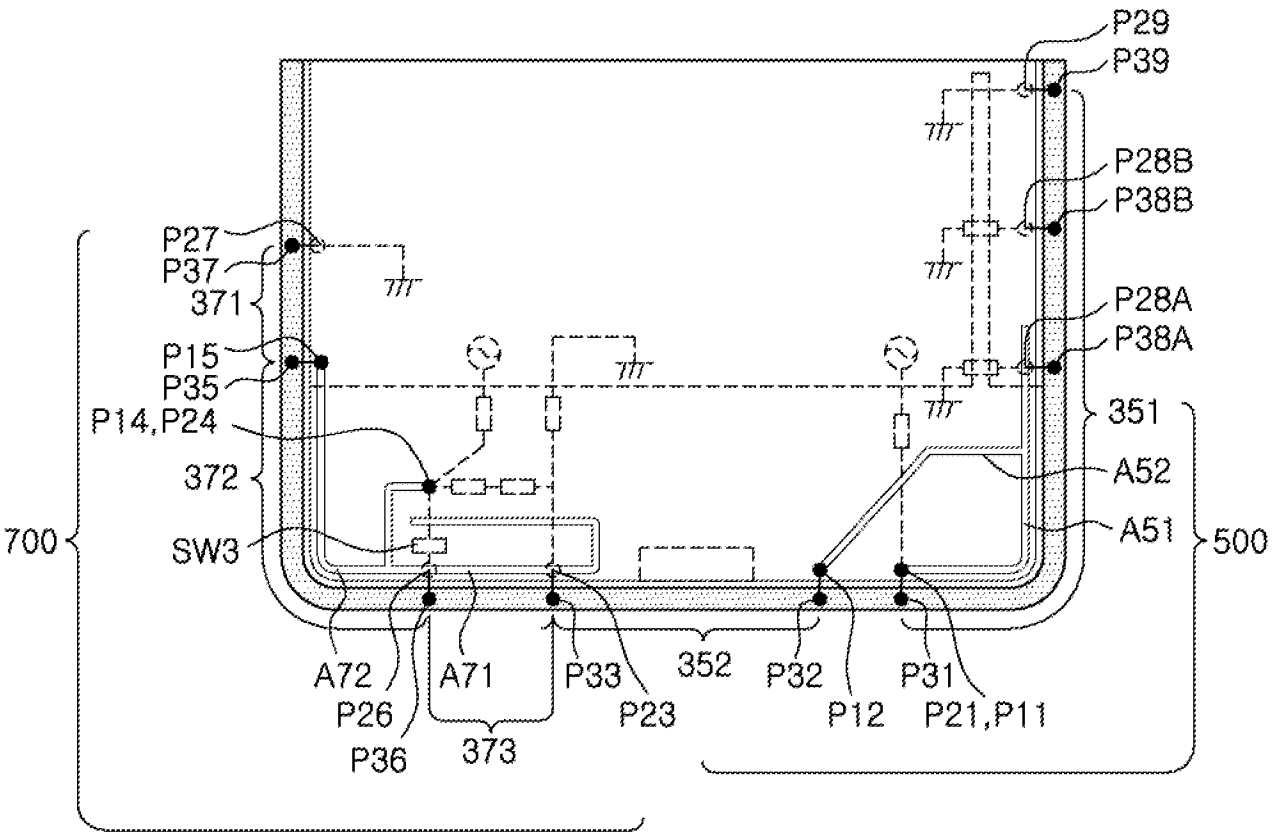
FIG. 5 is a diagram illustrating a second embodiment of the multi-band antenna of FIG. 4.

FIGS. 4 and 5 are diagrams illustrating an embodiment of the multi-band antenna.

FIGS. 4 and 5 are diagrams illustrating an embodiment of the multi-band antenna, in which the contents overlapping described with reference to FIGS. 1 through 3 may be omitted. In addition to the description of FIGS. 4-5 below, the above descriptions of FIGS. 1-3, are also applicable to FIGS. 4-5, and are incorporated herein by reference. Thus, the above description may not be repeated here.

The second antenna apparatus 700 may include the third outer conductor part 371 and the fourth outer conductor part 372. The third outer conductor part 371 is described with reference to FIGS. 2 and 3, and therefore the description thereof will be omitted.

In an example, the fourth outer conductor part 372 includes conductive border members 300 from the fifth point P35 of the conductive border member 300 to a seventh point P36 spaced as much as a sixth electrical length apart in the other direction.

For example, the fourth outer conductor part 372 includes conductive border members 300 from the contact P35 (fifth point) to a contact P36 (seventh point) spaced as much as the sixth electrical length (P35-P36) apart in the other direction.

The seventh point P36 of the fourth outer conductor part 371 may be connected to the second feed terminal 701 of the substrate 200 through a switch SW3.

Referring to FIGS. 4 and 5, the first antenna apparatus 500 may include at least one switch for controlling the current path and the frequency band. An example where the first antenna apparatus 500 includes a first switch SW1 and a second switch SW2 will be described.

In an example, the first switch SW1 and the second switch SW2 are disposed on the substrate 200. In an example, the first switch SW1 may include one terminal and the other terminal connected to the ground part GND of the substrate 200. One terminal of the first switch SW1 is electrically connected to the first outer conductor part 351 through a contact P28A of the substrate 200 and a contact P38A of the conductive border member 300. In an example, the contact P38A of the conductive border member 300 is positioned between the contact P31 and the contact P39.

The second switch SW2 includes one end connected to the ground part GND of the substrate 200. Another end of the second switch SW2 is electrically connected to the first outer conductor part 351 through a contact P28B of the substrate 200 and a contact P38B of the conductive border member 300. In an example, the contact P38B of the conductive border member 300 is positioned between the contact P38A and the contact P39.

For example, when the first switch SW1 is in a turned-off state and the second switch SW2 is in a turned-on state, a current path may not arrive at the ground part GND of the substrate 200 through the contact P39 of the first outer conductor part 351 but may arrive at the ground part GND of the substrate 200 through the contact P38B of the first outer conductor part 351. Thus, the current path may be short, and the frequency band may be controlled to be high by the first antenna apparatus 500 (see FIGS. 8A and 8B, B20→B5).

In another example, when the second switch SW2 is in a turned off state and the first switch SW1 is in a turned on state, a current path may not arrive at the ground part GND of the substrate 200 through the contact P39 of the first outer conductor part 351 but may arrive at the ground part GND of the substrate 200 through the contact P38A of the first outer conductor part 351. Thus, the current path may be shorter, and the frequency band may be controlled to be higher by the first antenna apparatus 500 (see FIGS. 8B and 8C, B20 or B5→B8).

Referring to FIGS. 4 and 5, the second antenna apparatus 700 may include at least one switch for controlling the current path and the frequency band. Another example, where the second antenna apparatus 700 includes a third switch SW3 will be described.

The third switch SW3 may be disposed on the substrate 200. In an example, the third switch SW3 includes one end connected to the contact P24. The other end of the third switch SW3 may be electrically connected to the conductive border member 300 through the contacts P26 and P36 of the substrate 200. The contact P36 may be positioned between the contact P33 and the contact P35.

When the third switch SW3 is in a turned-on state, a new current path passing through the third switch SW3 may be formed, and thus a new frequency band may be covered by the second antenna apparatus 700. For example, one current path may arrive at a ground through the second feed terminal 701, the third capacitance part C71, the contact P24, the third switch SW3, the contacts P26 and P36, the third and fourth outer conductor parts 371 and 372, and the contacts P37 and P27.

Figure 9A:
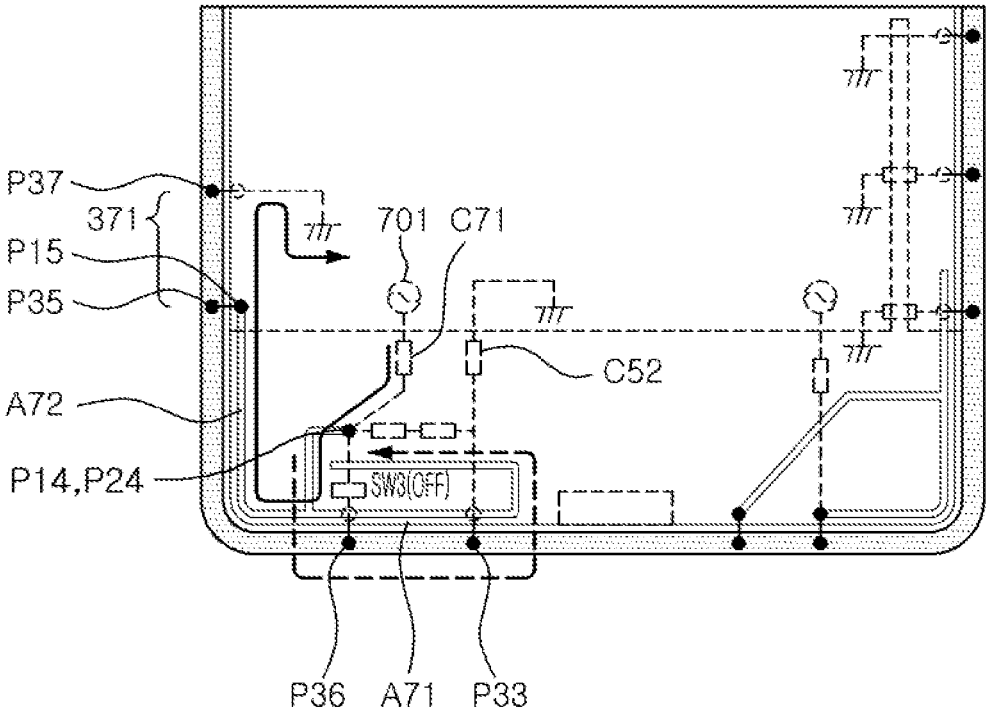
FIGS. 9A and 9B are diagrams illustrating a structure of a current path of the second antenna apparatus, according to an embodiment.
Figure 9B:
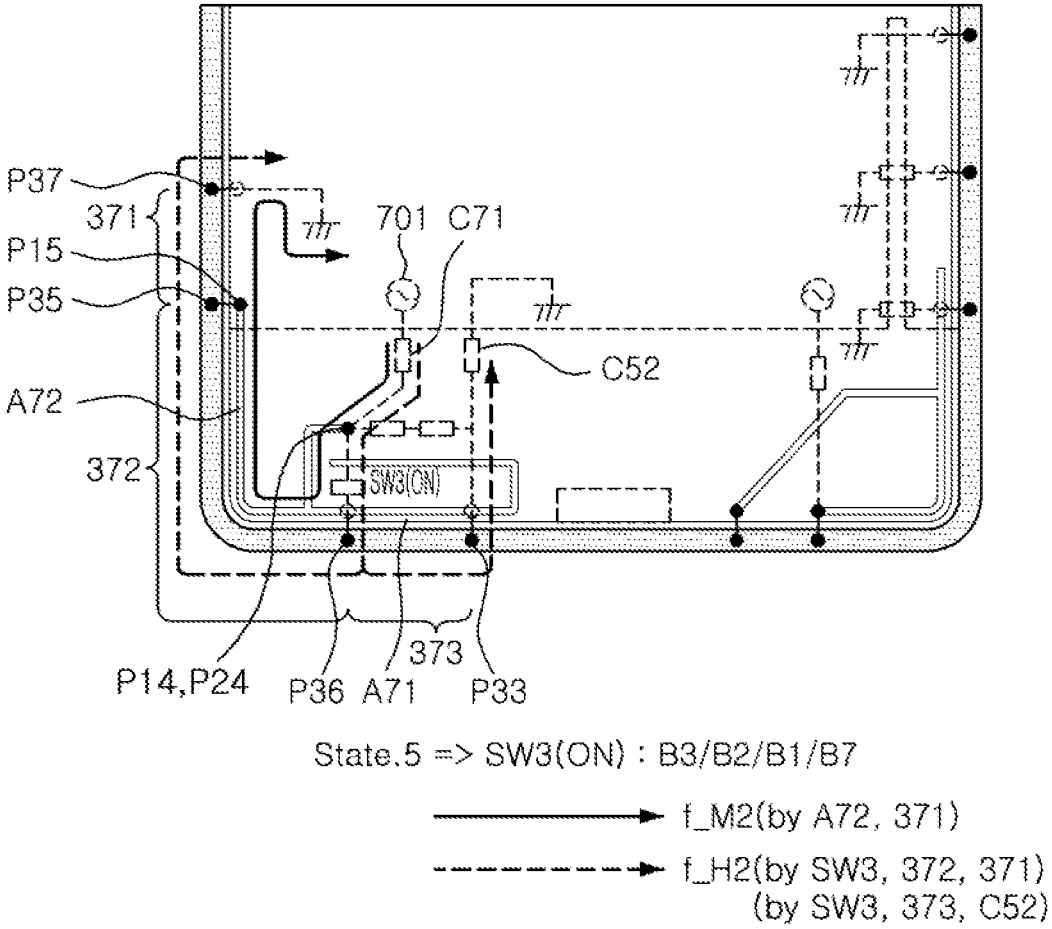

As a result, the relatively shorter current path may be created, and thus the frequency band may be controlled to be high by the third switch SW3 (see FIGS. 9A and 9B, B30→B7).

In an example, another current path may arrive at the ground part GND through the second feed terminal 701, the third capacitance part C71, the contact P24, the third switch SW3, the contacts P26 and P36, a fifth outer counter part 373, the contacts P33 and P23, and the second capacitor circuit part C52. In this case, the current signal may be bypassed to the ground part GND by the second capacitor circuit part C52, and therefore may not have an effect on the first antenna apparatus 500.

In an example, the fifth outer conductor part 373 may include a conductive border member between the contact P36 and the contact P33 among the conductive border members 300.

Figure 6:
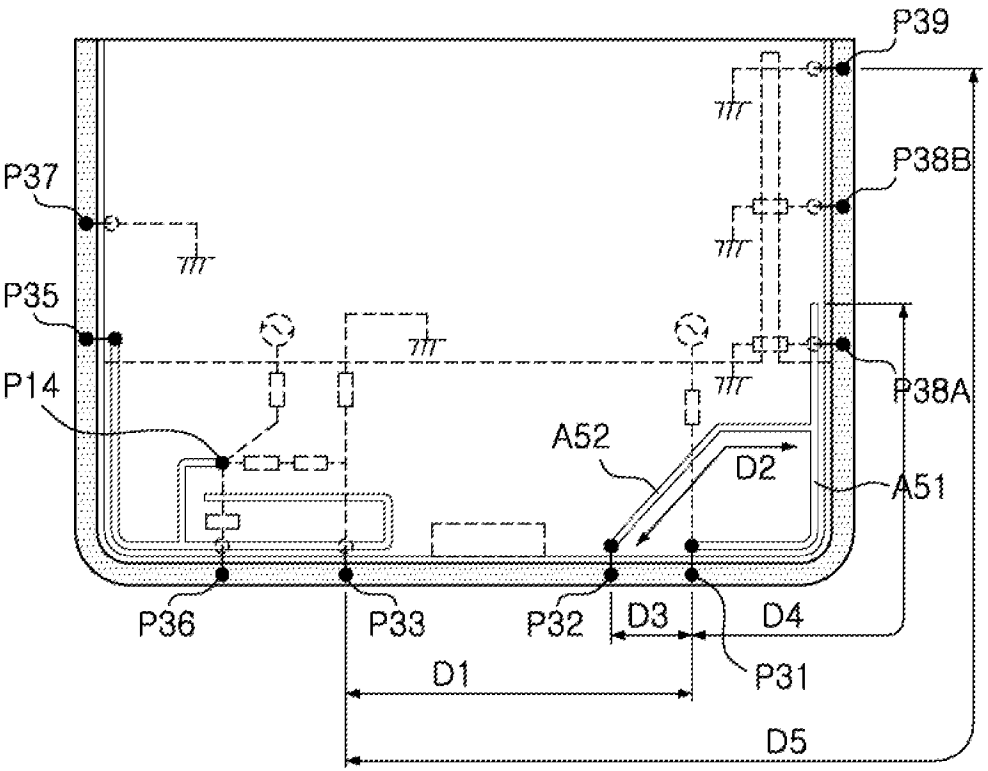
FIG. 6 is a diagram illustrating a disposition condition of the multi-band antenna, according to an embodiment.

FIG. 6 is a diagram illustrating an example of a disposition condition of the multi-band antenna.

Referring to FIG. 6, for the first antenna apparatus 500, a distance D1 between the contact P31 and the contact P33, a length D2 of the first bridge antenna pattern A52, a distance D3 between the contact P31 and the contact P32, a length D4 of the first antenna pattern A51, and a distance D5 between the contact P33 and the contact P39 may each be determined in consideration of wavelengths of frequency bands to be used.

For example, describing 900 MHz included in the low band (700 MHz through 1000 MHz), D1 may be a length of $\lambda/8$, D2 may be a length of $\lambda/11$, D3 may be a length of $\lambda/30$, D4 may be a length of $\lambda/8$, and D5 may be a length between $\lambda/3.5$ and $\lambda/4$. These lengths are only one example and other lengths may be used without departing from the spirit and scope of the illustrative examples described.

In another example, for the second antenna apparatus 700, a length of the third outer conductor part 371 corresponding to a distance between the contact P37 and the contact P35, a length of the fourth outer conductor part 372 corresponding to a distance between the contact P35 and the contact P36, and a length of the fifth outer conductor part 373 corresponding to a distance between the contact P36 and the contact P33 may each be determined in consideration of wavelengths of frequency bands to be used.

Figure 7A:
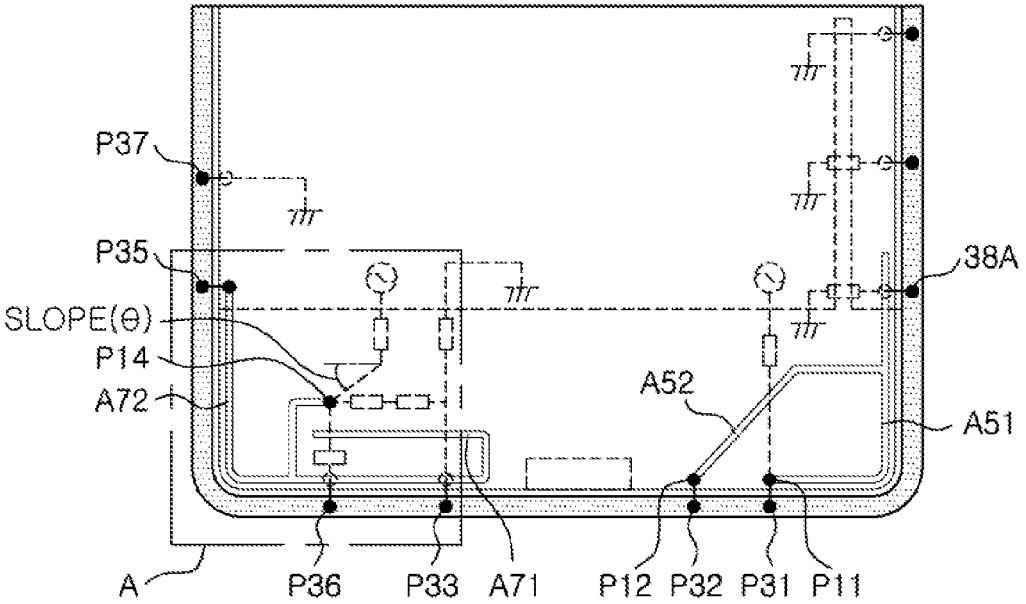
FIGS. 7A and 7B are diagrams illustrating a structure of a feeding line of a second antenna apparatus, according to an embodiment.
Figure 7B:
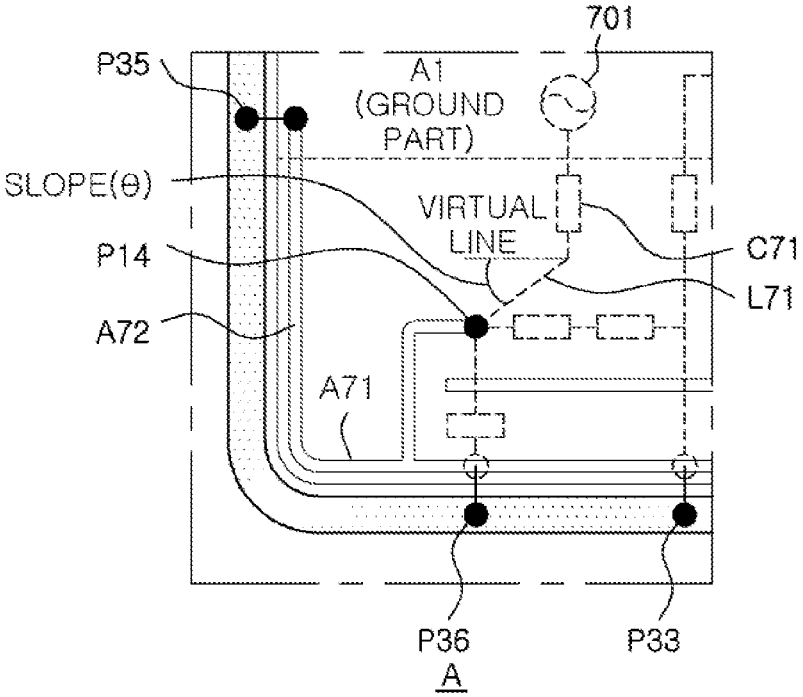

FIGS. 7A and 7B are diagrams illustrating a structure of a feeding line of a second antenna apparatus according to an embodiment.

Referring to FIGS. 7A and 7B, in the second antenna apparatus 700, a transmission line L71 between the contact P24 of the substrate 200 and the third capacitance part C71 may slant with a slope θ. In an example, the slope θ may be preset. The slope θ may be larger than 0° but smaller than 50° based on a horizontal virtual line. In an example, the slope θ may be 45°, but other slopes may be used without departing from the spirit and scope of the illustrative examples described.

In the transmission line, a current intensity may be strong along a boundary surface between the second antenna pattern A71 and the second bridge antenna pattern A72 and the ground part GND of the substrate 200, and may be strong around opposing corners between the antenna patterns A71 and A72 of the second antenna apparatus 700 and the conductive border member 300.

The oblique disposition of the transmission line L71 may control a current distribution intensity to be strong at the boundary surface of the ground part GND to improve a bandwidth.

Figure 8A:
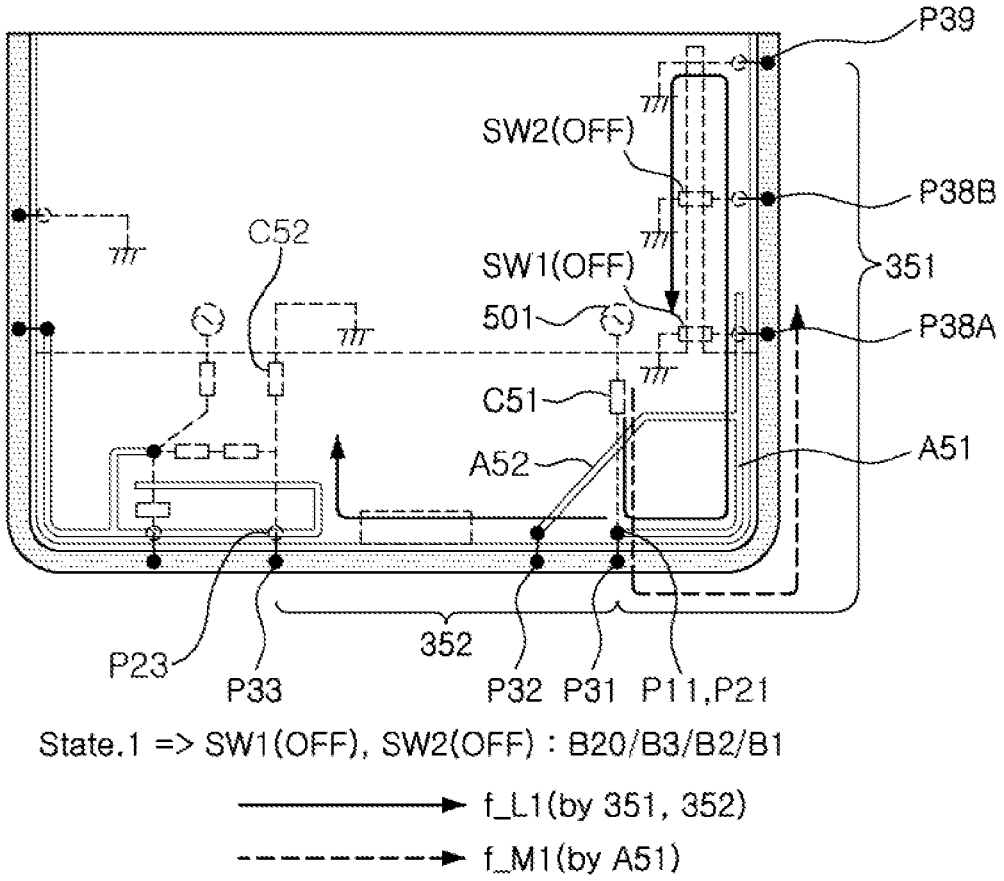
FIGS. 8A through 8C are diagrams illustrating a current path and a frequency band of a first antenna apparatus, according to an embodiment.
Figure 8B:
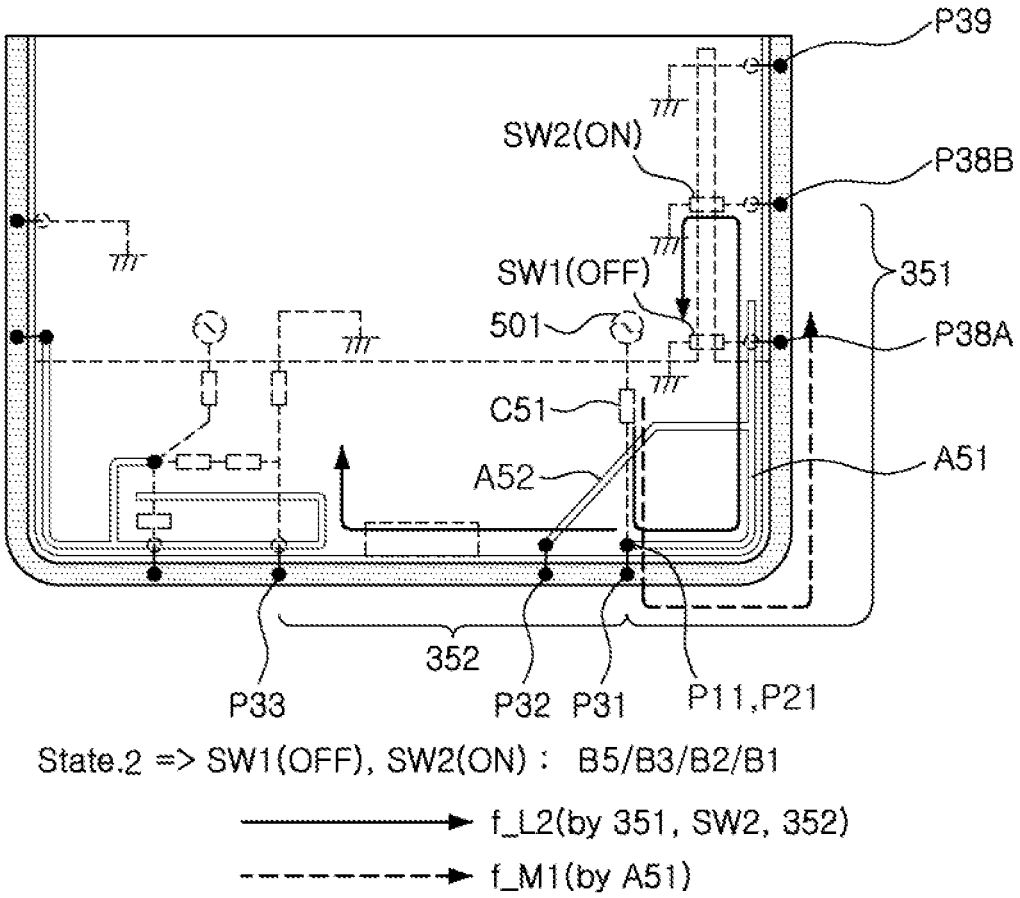
Figure 8C:
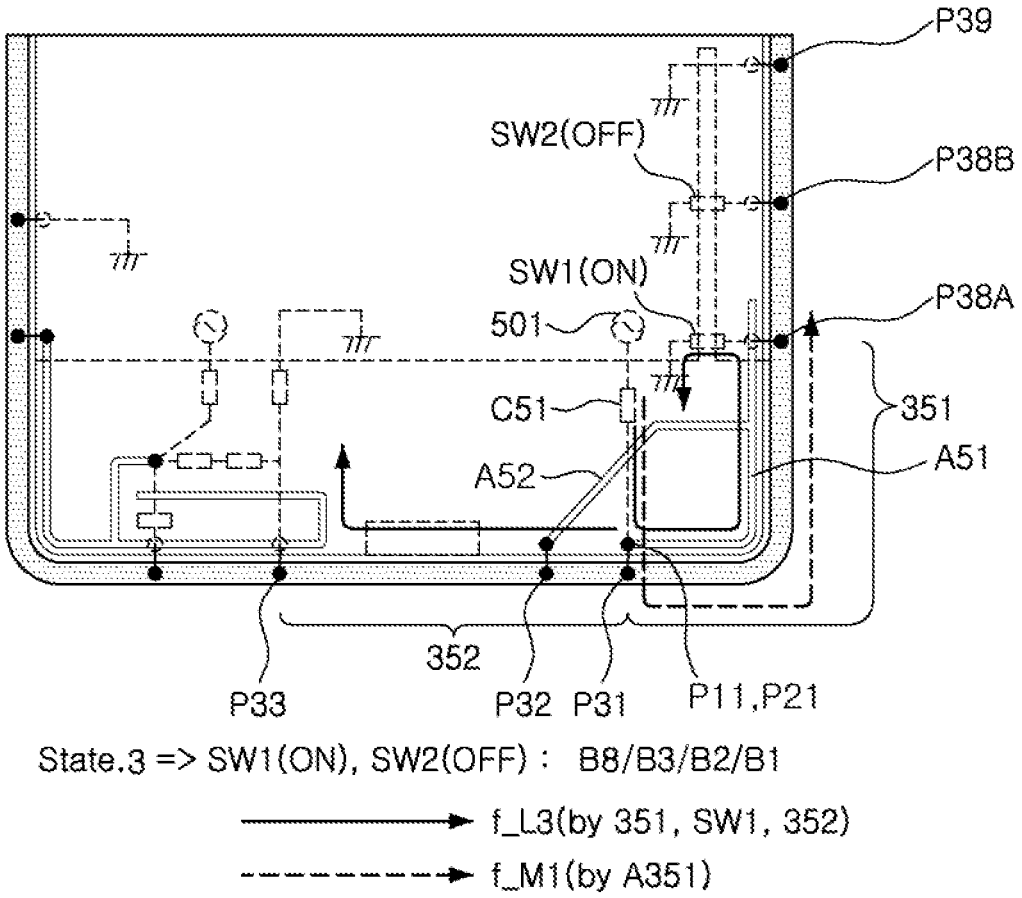

FIGS. 8A through 8C are diagrams illustrating a current path and a frequency band of a first antenna apparatus according to an embodiment.

The case in which one or both of the first and second switches SW1 and SW2 of the first antenna apparatus 500 are in a turned-off state will be described with reference to FIGS. 4 and 8A through 8C.

If the current signal is supplied through the first feed terminal 501 of the first antenna apparatus 500, one current path may be formed through the first antenna pattern A51 via the first capacitance part C51 and the contacts P21 and P11, and may be the same as the current path described with reference to FIGS. 2 and 3. The current path may correspond to a first middle band f_M1.

In an example, the first middle band f_M1 may include B3 (1710 MHz through 1880 MHz), B2 (1850 MHz through 1990 MHz), and B1 (1920 MHz through 2170 MHz) in the middle band (1700 MHz through 2200 MHz).

The first bridge antenna pattern A52 may serve as a stub for bandwidth expansion, may have a length shorter than the length of the first antenna pattern A51, and may serve to expand the bandwidth of the first middle band f_M1.

The case in which both of the first and second switches SW1 and SW2 of the first antenna apparatus 500 are in a turned-off state will be described with reference to FIGS. 4 and 8A.

In this case, the current path may arrive at the ground part GND of the substrate 200 through the first outer conductor part 351, the contacts P39 and P29, via the first capacitance part C51, and the contacts P21 and P31. The current path may be the same as the current path described with reference to FIGS. 2 and 3. The current path may correspond to a first low band f_L1.

In an example, the first low band f_L1 may include B20 (791 MHz through 862 MHz) in the low band (700 MHz through 1000 MHz).

In this case, the current signal may arrive at the ground part GND of the substrate 200 through the second capacitor circuit part C52 via the first capacitance part C51 and the contacts P21 and P31, and additionally via the second outer conductor part 352 and the contacts P33 and P23. The current signal may be bypassed to the ground without affecting the second antenna apparatus 700 due to the second capacitor circuit part C52. Such a current path may be identically applied in FIGS. 8A through 8C.

In this case, the capacitance of the second capacitor circuit part C52 may be large enough to alternately ground an alternating current signal. As a result, the current signal may be bypassed to the ground by the second capacitor circuit part C52, and thus the isolation between the first antenna apparatus 500 and the second antenna apparatus 700 may be improved.

The first switch SW1 and the second switch SW2 of the first antenna apparatus 500 will be described with reference to FIGS. 4 and 8B. The first switch SW1 is in a turned-off state and the second switch SW2 is in a turned-on.

In this case, the current path may arrive at the ground through the first outer conductor part 351, the contacts P38B and P28B, via the first capacitance part C51, and the contacts P21 and P31, and may correspond to a second low band f_L2. The second low band f_L2 may be a frequency band higher than the first low band f_L1.

The second low band f_L2 may include B5 (824 MHz through 894 MHz) in the low band (700 MHz through 1000 MHz).

The first switch SW1 and the second switch SW2 of the first antenna apparatus 500 will be described with reference to FIGS. 4 and 8C. The first switch SW1 is in a turned-on state and second switch SW2 is in a turned-off state.

In this case, the current path may arrive at the ground through the first outer conductor part 351, the contacts P38A and P28A, via the first capacitance part C51, and the contacts P21 and P31, and may correspond to a third low band f_L3. The third low band f_L3 may be a frequency band lower than the second low band f_L2.

The third low band f_L3 may include B8 (880 MHz through 960 MHz) in the low band (700 MHz through 1000 MHz).

FIGS. 9A and 9B are diagrams illustrating examples of a structure of a current path of the second antenna apparatus.

The case in which the third switch SW3 of the second antenna apparatus 500 is in a turned off state will be described with reference to FIGS. 4 and 9A and 9B.

If the current signal is supplied through the second feed terminal 701 of the second antenna apparatus 700, one current path may arrive at the ground through the third outer conductor part 371, the contacts P37 and P27, via the third capacitance part C71, and the contacts P24 and P14, additionally via the second bridge antenna pattern A72, and the contacts P15 and P35. The current path may correspond to a second middle band f_M2. Such a current path may be identically applied in FIGS. 9A and 9B.

The second middle band f_M2 may include B3 (1710 MHz through 1880 MHz), B2 (1850 MHz through 1990 MHz), and B1 (1920 MHz through 2170 MHz) in the middle band (1700 MHz through 2200 MHz).

Another current path may arrive at the ground part GND of the substrate 200 through the second capacitor circuit part C52 via the third capacitance part C71 and the contacts P24 and P14, additionally via the second bridge antenna pattern A72 and the contacts P15 and P35, and additionally via the fourth and fifth outer conductor parts 372 and 373 and the contacts P33 and P23 to make the current signal arrive at the ground part GND.

As a result, the current signal may be bypassed to the ground part GND of the substrate 200 by the second capacitor circuit part C52, and thus the isolation between the first antenna apparatus 500 and the second antenna apparatus 700 may be improved.

If the current signal is supplied through the second feed terminal 701 of the second antenna apparatus 700, another current path may pass through the second antenna pattern A71 via the third capacitance part C71 and the contacts P24 and P14. The current path may correspond to a first high band f_H1.

Here, the first high band f_H1 may include B30 (2305 MHz through 2360 MHz) in the high band (2300 MHz through 2700 MHz).

The case in which the third switch SW3 of the second antenna apparatus 500 is in a turned on state will be described with reference to FIGS. 4 and 9A and 9B.

First, if the current signal is supplied through the second feed terminal 701 of the second antenna apparatus 700, one current path may pass through the second capacitor circuit part C52 via the third capacitance part C71, the third switch SW3, the contacts P26 and P36, and additionally via the fifth outer conductor part 373 and the contacts P33 and P23.

Another current path may arrive at the ground through the third and fourth outer conductor parts 372 and 371 and the contacts P37 and P27 via the third capacitance part C71, the third switch SW3, and the contacts P26 and P36. The current path may correspond to a second high band f_H2.

Here, the second high band f_H2 may include B7 (2500 MHz through 2690 MHz) in the high band (2300 MHz through 2700 MHz).

Figure 10A:
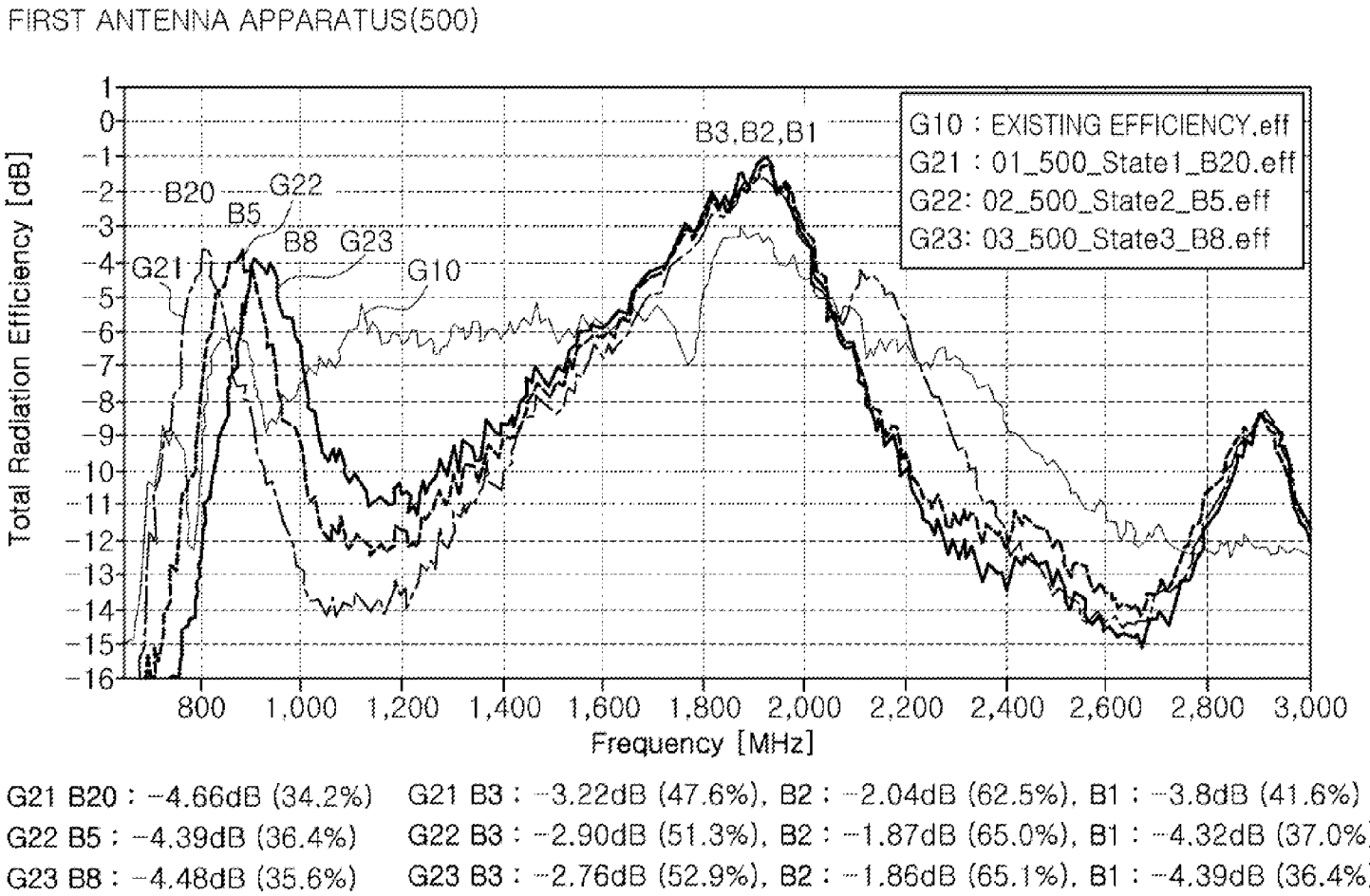
FIGS. 10A and 10B are diagrams illustrating radiation efficiency characteristics for each frequency band of the multi-band antenna, according to an embodiment.
Figure 10B:
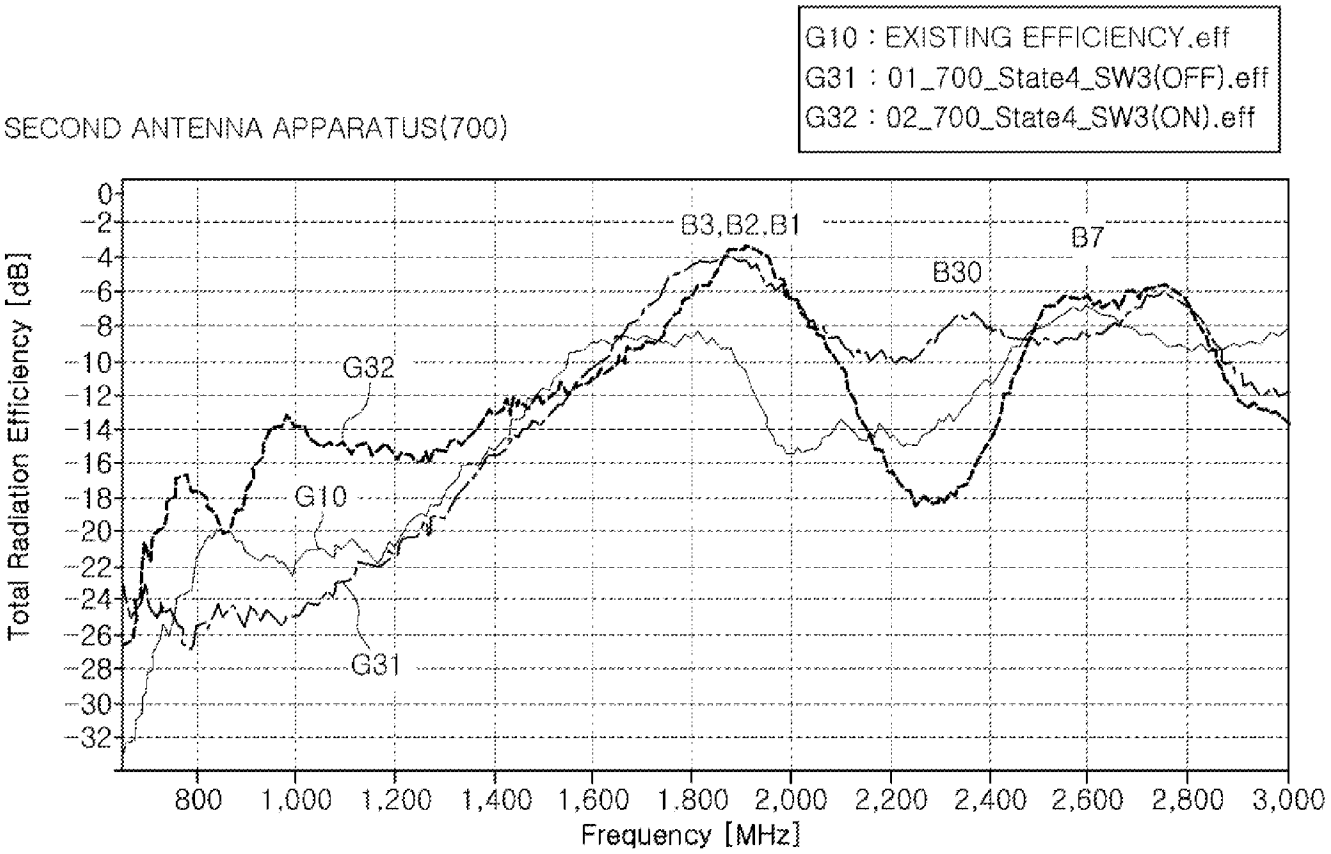

FIGS. 10A and 10B are diagrams showing radiation efficiency characteristics for each frequency band of the multi-band antenna according to the embodiment.

FIG. 10A is a characteristic diagram showing radiation efficiencies for each frequency band of the first antenna apparatus 500, and FIG. 10B is a characteristic diagram showing radiation efficiencies for each frequency band of the second antenna apparatus 700.

In FIG. 10A, the existing graph G10 may be a characteristic graph of the existing electronic device, a graph G21 may be a characteristic graph when the first and second switches SW1 and SW2 are in a turned off state, a graph G22 may be a characteristic graph when only the second switch SW2 is in a turned on state, and a graph G23 may be a characteristic graph when only the first switch SW1 is in a turned on state.

Referring to the graph shown in FIG. 10A, it is shown that the middle bands B3, B2, and B1 of approximately 1700 MHz through 2200 MHz corresponding to the first middle band f_M1 may be covered by the first antenna apparatus 500, and the plurality of low bands B20, B5, and B8 of 700 MHz through 1000 MHz may be covered by the first antenna apparatus 500 depending on the state of the first and second switches SW1 and SW2.

In FIG. 10B, the existing graph G10 may be a characteristic graph of the existing electronic device, a graph G31 may be a characteristic graph when the third switch SW3 is in a turned off state, and a graph G32 may be a characteristic graph when the third switch SW3 is in a turned on state.

Referring to the graph shown in FIG. 10B, it is shown that the middle bands B3, B2, and B1 of approximately 1700 MHz through 2200 MHz corresponding to the second middle band f_M2 may be covered by the second antenna apparatus 700, and the plurality of high bands B30 and B7 of 2,300 MHz through 2,700 MHz may be covered by the second antenna apparatus 700 depending on the state of the third switch SW3.

As set forth above, according to the embodiment, the electronic device with the conductive border member may use the non-segmented conductive border member to control a low band, a middle band, and a high band, thereby supporting the carrier-aggregation (CA) while securing the antenna performance depending on the frequency environment or the system environment and implementing 1UL/2DLs or 1UL/3DLS.

As set forth above, according to the embodiments, an electronic device including a multi-band antenna, a cover, a substrate, and a conductive border includes a first feed terminal connected to a circuit of a substrate embedded in the device, a second feed terminal connected to the circuit and insulated from the first feed terminal, a ground disposed on the substrate, a conductive border member continuously disposed along a periphery of the electronic device, a first antenna connected to the first feed terminal and the conductive border member, and the first antenna forming a multiple resonance for covering a first multi-band having a plurality of bands, a second antenna connected to the second feed terminal and the conductive border member and the second antenna forming a multiple resonance for covering a second multi-band, and a or the bypass conductor to bypass interference signals generated by the first antenna and the second antenna to the ground.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An electronic device, comprising:

a first feed terminal connected to a circuit of a substrate embedded in the electronic device;

a second feed terminal connected to the circuit and electrically insulated from the first feed terminal;

a ground disposed on the substrate;

a conductive border member continuously disposed along a periphery of the electronic device;

a first antenna connected to the first feed terminal and the conductive border member, and forming a multiple resonance for covering a first multi-band having a plurality of bands;

a second antenna connected to the second feed terminal and the conductive border member and forming a multiple resonance for covering a second multi-band; and a bypass circuit path disposed between the first antenna and the second antenna and configured to bypass interference signals generated by the first antenna and the second antenna to the ground.

2. The electronic device of claim 1, wherein the first antenna comprises:

a first antenna pattern disposed along an edge of a cover of the electronic device, the first antenna pattern having a first end connected to the first feed terminal and the conductive border member and a second end open, and the first antenna pattern having a first electrical length; and a first bridge antenna pattern disposed on the cover, first bridge antenna pattern having a first end connected to the first antenna pattern and a second end connected to the conductive border member.

3. The electronic device of claim 2, wherein the first antenna further comprises:

a first outer conductor comprising a portion of the conductive border member from a first point connected to the first feed terminal and the first antenna pattern to a second point spaced at a second electrical length apart from the first point in a first direction; and a second outer conductor comprising a portion of the conductive border member from a third point of the conductive border member to a fourth point spaced at a third electrical length apart from the third point in a second direction, and wherein the second point is connected to the ground, the third point is connected to the second end of the first bridge antenna pattern, and the fourth point is connected to the bypass circuit path.

4. The electronic device of claim 3, wherein the second antenna comprises:

a second antenna pattern disposed on the cover, the second antenna pattern having one end connected to the second feed terminal and the other end open, and the second antenna pattern having a fourth electrical length; and a second bridge antenna pattern disposed on the cover and having one end connected to the second antenna pattern and the other end connected to the conductive border member.

5. The electronic device of claim 4, wherein the second antenna further comprises:

a third outer conductor comprising a portion of the conductive border member from a fifth point of the conductive border member connected to the other end of the second bridge antenna pattern to a sixth point spaced at a fifth electrical length apart in one direction; and a fourth outer conductor comprising a portion of the conductive border member from the fifth point of the conductive border member to a seventh point spaced as much as a sixth electrical length apart in the other direction, and wherein the sixth point is connected to the ground of the substrate and the seventh point is connected to the second feed terminal through a switch.

6. The electronic device of claim 4, wherein the second antenna further comprises a matching circuit disposed between the first end of the second antenna pattern and the fourth point to form impedance matching for a high band in the second multi-band.

7. The electronic device of claim 6, wherein the first antenna further comprises:

a first capacitor circuit inserted into a transmission line connecting the first feed terminal to the first point, and the bypass circuit path comprises a second capacitor circuit disposed between one point of the conductive border member between the second outer conductor and the fourth outer conductor and the ground to have a capacitance for bypassing the signal generated by the first antenna to the ground.

8. The electronic device of claim 7, wherein the matching circuit comprises fourth and fifth capacitance parts connected to each other in series, and the fourth and the fifth capacitance parts each comprise a capacitance element having a level of capacitance less than that of the second capacitor circuit.

9. The electronic device of claim 1, wherein the first multi-band and the second multi-band overlap each other.

10. The electronic device of claim 1, wherein the first multi-band and the second multi-band do not overlap each other.

11. The electronic device of claim 1, wherein the bypass circuit path is configured to connect the conductive border member between the first antenna and the second antenna to the ground.

12. An electronic device, comprising:

a first feed terminal connected to a circuit of a substrate embedded in the electronic device;

a second feed terminal connected to the circuit and electrically insulated from the first feed terminal;

a ground disposed on the substrate;

a conductive border member continuously disposed along a periphery of the electronic device;

a first antenna comprising a first antenna pattern connected to the first feed terminal and the conductive border member and the first antenna forming a multiple resonance for covering a first multi-band having a plurality of bands using the first antenna pattern and the conductive border member;

a second antenna comprising a second antenna pattern connected to the second feed terminal and the conductive border member, and forming a multiple resonance for covering a second multi-band that does not overlap the first multi-band using the second antenna pattern and the conductive border member; and a bypass circuit path disposed between the first antenna and the second antenna and configured to alternately connect the conductive border member between the first antenna and the second antenna to the ground.

13. The electronic device of claim 12, wherein the first antenna pattern comprises:

a first antenna pattern disposed along an edge of a cover of the electronic device, the first antenna pattern having a first end connected to the first feed terminal and the conductive border member, and a second end open, and the first antenna pattern having a first electrical length; and a first bridge antenna pattern disposed on the cover and having a first end connected to the first antenna pattern and a second end connected to the conductive border member.

14. The electronic device of claim 13, wherein the first antenna further comprises:

a first outer conductor comprising a portion of the conductive border member from a first point connected to the first feed terminal and the first antenna pattern to a second point spaced at a second electrical length apart in a first direction; and a second outer conductor comprising a portion of the conductive border member from a third point of the conductive border member to a fourth point spaced at a third electrical length apart from the third point in a second direction, and wherein the second point is connected to the ground of the substrate, the third point is connected to the second end of the first bridge antenna pattern, and the fourth point is connected to the bypass circuit path.

15. The electronic device of claim 14, wherein the second antenna pattern comprises:

a second antenna pattern disposed on the cover, having a first end connected to the second feed terminal and a second end open, and the second antenna pattern having a fourth electrical length; and a second bridge antenna pattern disposed on the cover and having a first end connected the second antenna pattern and a second end connected to the conductive border member.

16. The electronic device of claim 15, wherein the second antenna further comprises:

a third outer conductor comprising a portion of the conductive border member from a fifth point of the conductive border member connected to the second end of the second bridge antenna pattern to a sixth point spaced at a fifth electrical length apart in one direction; and a fourth outer conductor comprising a portion of the conductive border member from the fifth point of the conductive border member to a seventh point spaced as much as a sixth electrical length apart in the other direction, and wherein the sixth point is connected to the ground of the substrate and the seventh point is connected to the second feed terminal through a switch.

17. The electronic device of claim 16, wherein the second antenna further comprises a matching circuit disposed between the first end of the second antenna pattern and the fourth point to form impedance matching for a high band in the second multi-band.

18. The electronic device of claim 16, wherein the first antenna apparatus further comprises:

a first capacitor circuit inserted into a transmission line connecting the first feed terminal to the first point, and the bypass circuit path comprises a second capacitor circuit disposed between one point of the conductive border member between the second outer conductor and the fourth outer conductor and the ground to have a capacitance for bypassing the signal generated by the first antenna apparatus to the ground.

19. The electronic device of claim 18, wherein the first antenna apparatus further comprises:

a switch controlling a current path and a frequency band.

20. The electronic device of claim 12, wherein the bypass circuit path is further configured to bypass signals generated by the first antenna and the second antenna to the ground.

21. An electronic device, comprising:

a first feed terminal connected to a circuit of a substrate of the electronic device;

a second feed terminal connected to the circuit and electrically insulated from the first feed terminal;

a conductive border member disposed along a periphery of the electronic device;

a first antenna comprising a first switch configured to control the current path and the frequency band, and the first antenna being connected to the first feed terminal and the conductive border member;

a second antenna comprising a second switch configured to control the current path and the frequency band, and the second antenna being connected to the second feed terminal and the conductive border member; and a bypass circuit path configured to bypass interference signals generated by the first antenna and the second antenna to a ground of the substrate.

22. The electronic device of claim 21, wherein the first antenna further comprises:

a first outer conductor comprising a portion of the conductive border member extending from a first point connected to the first feed terminal and a first antenna pattern of the first antenna to a second point connected to the ground; and a second outer conductor comprising a portion of the conductive border member extending from a third point connected to a first bridge antenna pattern of the first antenna to a fourth point connected to the bypass circuit path.

23. The electronic device of claim 22, wherein the first switch is disposed on the substrate between the first point and the second point, and the first switch comprises a first terminal connected to the ground and a second terminal connected to the first outer conductor.

24. The electronic device of claim 21, wherein the second antenna further comprises:

a third outer conductor comprising a portion of the conductive border member extending from a fifth point connected to an end of a second bridge antenna pattern of the second antenna to a sixth point connected to the ground; and a fourth outer conductor comprising a portion of the conductive border member extending from the from the fifth point to a seventh point connected to the second feed terminal through a switch.

25. The electronic device of claim 24, wherein the second switch is disposed on the substrate, and the second switch comprises a first terminal connected to the second feed terminal and a second terminal connected to the fourth outer conductor.

26. An electronic device, comprising:

a first feed terminal connected to a circuit of a substrate embedded in the electronic device;

a second feed terminal connected to the circuit and electrically insulated from the first feed terminal;

a ground disposed on the substrate;

a conductive border member continuously disposed along a periphery of the electronic device;

a first antenna connected to the first feed terminal and the conductive border member, and forming a multiple resonance for covering a first multi-band having a plurality of bands;

a second antenna connected to the second feed terminal and the conductive border member and forming a multiple resonance for covering a second multi-band; and a bypass circuit path configured to bypass interference signals generated by the first antenna and the second antenna to the ground, wherein the first antenna further comprises:

a first conductor that comprises a first point connected to the first feed terminal and a first antenna pattern, and a second point connected to the ground; and a second conductor that comprises a fourth point connected to the bypass circuit path.

27. The electronic device of claim 26, further comprising a third point connected to a first bridge antenna pattern.

* * * * *